US011971235B2

(12) United States Patent
Petersen

(10) Patent No.: US 11,971,235 B2
(45) **Date of Patent: *Apr. 30, 2024**

(54) FIREARM SUPPRESSOR WITH GAS DEFLECTOR

(71) Applicant: TRUE VELOCITY IP HOLDINGS, LLC, Garland, TX (US)

(72) Inventor: Byron S. Petersen, Springfield, OR (US)

(73) Assignee: TRUE VELOCITY IP HOLDINGS, LLC, Garland, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/171,219

(22) Filed: Feb. 17, 2023

(65) Prior Publication Data

US 2023/0213300 A1 Jul. 6, 2023

Related U.S. Application Data

(63) Continuation of application No. 17/204,820, filed on Mar. 17, 2021, now Pat. No. 11,609,058.

(60) Provisional application No. 63/133,597, filed on Jan. 4, 2021.

(51) Int. Cl.

| | |
|---|---|
| ***F41A 21/30*** | (2006.01) |
| ***F41A 21/32*** | (2006.01) |
| *F41A 21/34* | (2006.01) |

(52) U.S. Cl.

CPC ..... *F41A 21/30* (2013.01); *F41A 21/325* (2013.01); *F41A 21/34* (2013.01)

(58) Field of Classification Search

CPC ..... F41A 21/30; F41A 21/32; F41A 21/34

See application file for complete search history.

(56) References Cited

U.S. PATENT DOCUMENTS

| | | | | |
|---|---|---|---|---|
| 1,021,742 A | | 3/1912 | Moore | |
| 2,313,669 A | * | 3/1943 | Reising | F41A 21/36 89/14.3 |
| 2,514,996 A | | 7/1950 | Faust, Jr. | |
| 3,455,203 A | * | 7/1969 | Pillersdorf | F41A 21/34 89/14.3 |
| 3,492,912 A | * | 2/1970 | Ashbrook | F41A 21/36 181/269 |

(Continued)

FOREIGN PATENT DOCUMENTS

| | | |
|---|---|---|
| WO | 2014076356 A1 | 5/2014 |
| WO | 2019134011 A1 | 7/2019 |

OTHER PUBLICATIONS

"Engineering Design Handbook, Guns Series, Muzzle Devices," No. AD0838748, Defense Technical Information Center Website, Available Online at https://apps.dtic.mil/sti/citations/AD0838748, May 1, 1968, 138 pages.

(Continued)

*Primary Examiner* — Derrick R Morgan

(74) *Attorney, Agent, or Firm* — Burdick Patents, P.A.; Sean D. Burdick; Colin L. Honan

(57) ABSTRACT

Methods and systems are provided for firearm sound suppressors including a gas deflector. In one example, a suppressor comprises a housing, a projectile entrance, a projectile exit, one or more baffles, and a deflector chamber. The deflector extending outward from the housing and the deflector curving around a central axis of the suppressor.

20 Claims, 15 Drawing Sheets

(56) References Cited

U.S. PATENT DOCUMENTS 4,643,073 A * 2/1987 Johnson ..... F41A 21/36 89/14.3
5,076,137 A * 12/1991 Paredes ..... F41A 21/36 89/14.3
5,476,028 A * 12/1995 Seberger ..... F41A 21/36 89/14.3
6,308,609 B1 * 10/2001 Davies ..... F41A 21/30 89/14.4
6,575,074 B1 * 6/2003 Gaddini ..... F41A 21/30 89/14.4
7,789,008 B2 * 9/2010 Petersen ..... F41A 21/30 89/14.4
8,042,448 B1 * 10/2011 Sylvester ..... F41A 21/36 42/1.06
8,820,473 B1 * 9/2014 White ..... F41A 21/34 89/14.4
9,500,427 B1 * 11/2016 Larue ..... F41A 21/30
9,513,078 B1 * 12/2016 Fulton ..... F41A 21/325
9,702,651 B2 * 7/2017 Petersen ..... F41A 21/28
10,024,618 B1 * 7/2018 Moore ..... F41A 21/36
10,393,463 B1 * 8/2019 Sanders ..... F41A 21/34
10,634,445 B1 * 4/2020 Klett ..... F41A 21/30
10,724,826 B1 * 7/2020 Phillips ..... F41C 27/20
11,209,233 B1 * 12/2021 Oglesby ..... F41A 21/32
11,428,489 B2 * 8/2022 Petersen ..... F41A 21/30
2006/0191525 A1 * 8/2006 Dai ..... F42B 5/145 89/14.6
2007/0069064 A1 * 3/2007 Mott ..... F41A 21/32 244/3.23
2007/0266844 A1 * 11/2007 Dueck ..... F41A 21/30 89/14.4
2009/0050403 A1 * 2/2009 Brittingham ..... F41A 21/325 181/223
2010/0163336 A1 * 7/2010 Presz, Jr. ..... F41A 13/08 181/223
2010/0180759 A1 * 7/2010 Petersen ..... F41A 21/30 89/14.4
2013/0269669 A1 * 10/2013 Appleton ..... F41B 11/73 124/56
2015/0001001 A1 * 1/2015 Wilson ..... F41A 21/36 219/76.1
2015/0136519 A1 * 5/2015 Moore ..... F41A 21/30 181/223
2015/0260472 A1 * 9/2015 Smith ..... F41A 21/30 89/14.2
2016/0061551 A1 * 3/2016 Petersen ..... F41A 21/30 89/14.4
2016/0076844 A1 * 3/2016 Miller, III ..... F41A 21/30 89/14.3
2017/0030672 A1 * 2/2017 Larue ..... F41A 21/325
2019/0017769 A1 * 1/2019 Gianelloni, III ..... F41A 21/30
2019/0249942 A1 * 8/2019 Dunham ..... F41A 21/30
2020/0072574 A1 * 3/2020 Griffitts ..... F41A 21/36
2020/0109907 A1 4/2020 Klett et al.
2020/0284541 A1 * 9/2020 Poling ..... F41A 21/30
2020/0340777 A1 * 10/2020 Yoon ..... F41B 11/89
2021/0190453 A1 * 6/2021 Kunsky ..... F41A 21/30
2021/0341246 A1 * 11/2021 Kunsky ..... F41A 21/30
2021/0381793 A1 * 12/2021 Slack ..... F41A 21/24
2021/0389076 A1 * 12/2021 Turnblom ..... F41A 21/36
2021/0404760 A1 * 12/2021 Hipp ..... F41A 21/36
2023/0028332 A1 * 1/2023 Wilson ..... B23K 35/3033

OTHER PUBLICATIONS

Schmidt, E., "Muzzle Devices, a State-of-the-Art Survey," vol. 1, No. AD0909325, Defense Technical Information Center Website, Available Online at https://apps.dtic.mil/sti/citations/AD0909325, Feb. 1, 1973, 115 pages.

Davis, B. et al., "A Synopsis of Yaw-Induction Techniques Used During Projectile Free-Flight Aerodynamics Experiments," Army Research Laboratory, ARL-RP-420, Mar. 2013, 26 pages.

ISA European Patent Office, International Search Report and Written Opinion Issued in Application No. PCT/US2021/073162, Apr. 21, 2022, WIPO, 13 pages.

* cited by examiner

FIREARM SUPPRESSOR WITH GAS DEFLECTOR

CROSS-REFERENCE TO RELATED APPLICATIONS

The present application claims priority to U.S. Utility application Ser. No. 17/204,820, entitled "FIREARM SUPPRESSOR WITH GAS DEFLECTOR," and filed on Mar. 17, 2021. U.S. Utility application Ser. No. 17/204,820 claims priority to U.S. Provisional Application No. 63/133,597, entitled "FIREARM SUPPRESSOR WITH GAS DEFLECTOR," and filed on Jan. 4, 2021. The entire contents of the above-identified application are hereby incorporated by reference for all purposes.

FIELD

Embodiments of the subject matter disclosed herein relate to firearm sound suppressors, and more particularly to employing a gas deflector in a firearm sound suppressor.

BACKGROUND

Firearms utilize high pressure exhaust gases to accelerate a projectile such as a bullet. Firearm silencers (hereafter referred to as "suppressors") are often added to the muzzle (exhaust) of a firearm to capture the high pressure exhaust gases of a given firearm. These high pressure exhaust gases are the product of burning nitrocellulose and possess significant energy that is used to accelerate the projectile. The typical exhaust gas pressure of a rifle cartridge in a full length barrel may be in the range of 7-10 Ksi. A short barreled rifle may have exhaust gas pressures in the 10-20 Ksi range. Moving at supersonic speeds through the bore, the exhaust gases provide the energy to launch the projectile and also result in the emanation of high-decibel noises typically associated with the discharge of firearms. When in action, firearm suppressors lower the kinetic energy and pressure of the propellant gases and thereby reduce the decibel level of the resultant noises.

Firearms suppressors are mechanical pressure reduction devices that contain a center through-hole to allow passage of the projectile. Suppressor design(s) utilize static geometry to induce pressure loss across the device by means that may include rapid expansion and contraction, minor losses related to inlet and outlet geometry, and induced pressure differential to divert linear flow.

Suppressors can be thought of as "in-line" pressure reduction devices that capture and release the high pressure gases over a time (T). Typical suppressor design approaches used to optimize firearms noise reduction include maximizing internal volume, and providing a baffled or tortuous pathway for propellant gas egress. Each of these approaches must be balanced against the need for clear egress of the projectile, market demand for small overall suppressor size, adverse impacts on the firearms performance, and constraints related to the firearms original mechanical design.

However, the inventor herein has recognized potential issues with such systems. As one example, excess heat build-up may arise due to the use of a suppressor on a firearm. Further, gases may accumulate within the baffled or tortuous pathway of the suppressor as a result of repeated firing of the firearm to which the suppressor is coupled. For example, autoloading firearms, both semi-automatic and automatic, are designed to utilize a portion of the waste exhaust gases to operate the mechanical action of the firearms. When in operation the mechanical action of the firearm automatically ejects the spent cartridge case and emplaces a new cartridge case into the chamber of the firearms barrel. Some autoloading designs tap and utilize exhaust gases from a point along the firearms barrel. The tapped gases provide pressure against the face of a piston, which in turn triggers the mechanical autoloading action of the firearm. The energy of the tapped exhaust gases supplies the work to operate the mechanical piston of the firearm enabling rapid cycling of cartridges. The use of the suppressor with such firearms may result in sustained elevated internal pressures which result in transmission of excess work energy to the piston during the course of operation, which may lead to opening of the breech (chamber) sooner than is supported by the original firearms design. Additionally, the accumulation of gases may increase gas pressure within the suppressor and reduce an ability of the suppressor to dampen acoustical emissions of the firearm.

Furthermore, conventional suppressor designs may add significant length and weight to a firearm.

In one embodiment, the issues described above may be addressed by a suppressor, comprising: a projectile entrance and a projectile exit; a baffle chamber within the suppressor comprising one or more baffles; a deflector chamber within the suppressor positioned between the baffle chamber and the projectile entrance; a separator wall separating the baffle chamber from the deflector chamber; a baffle chamber projectile entrance within the separator wall connecting the baffle chamber and deflector chamber; and a deflector extending from the projectile entrance cantilevered outward into the deflector chamber, and the deflector extending along a central axis of the suppressor. In this way, gases flowing to the suppressor at the projectile entrance may be deflected by the deflector away from a path of a projectile through the suppressor. As a result, a likelihood of accumulation of gases within the suppressor may be reduced, and an amount of noise reduction provided by the suppressor may be increased. Furthermore, the length and weight of a suppressor may be reduced by enabling use of less material.

It should be understood that the summary above is provided to introduce in simplified form, a selection of concepts that are further described in the detailed description. It is not meant to identify key or essential features of the subject matter. Furthermore, the disclosed subject matter is not limited to implementations that solve any disadvantages noted above or in any part of this disclosure.

The above drawings are approximately to scale, although other relative dimensions may be used, if desired. The drawings may depict components directly touching one another and in direct contact with one another and/or adjacent to one another, although such positional relationships may be modified, if desired. Further, the drawings may show components spaced away from one another without intervening components therebetween, although such relationships again, could be modified, if desired.

DETAILED DESCRIPTION

An example firearm suppressor including a gas deflector is described herein. The following description relates to various embodiments of the firearm sound suppressor as well as methods of manufacturing and using the device. Potential advantages of one or more of the example approaches described herein relate to increasing operating performance with autoloading firearms, reducing acoustical emissions of the firearm, eliminating rearward venting of exhaust gases during use with semi-automatic firearms, reducing length of a suppressor, reducing weight of a suppressor, and various others as explained herein.

Figure 1:
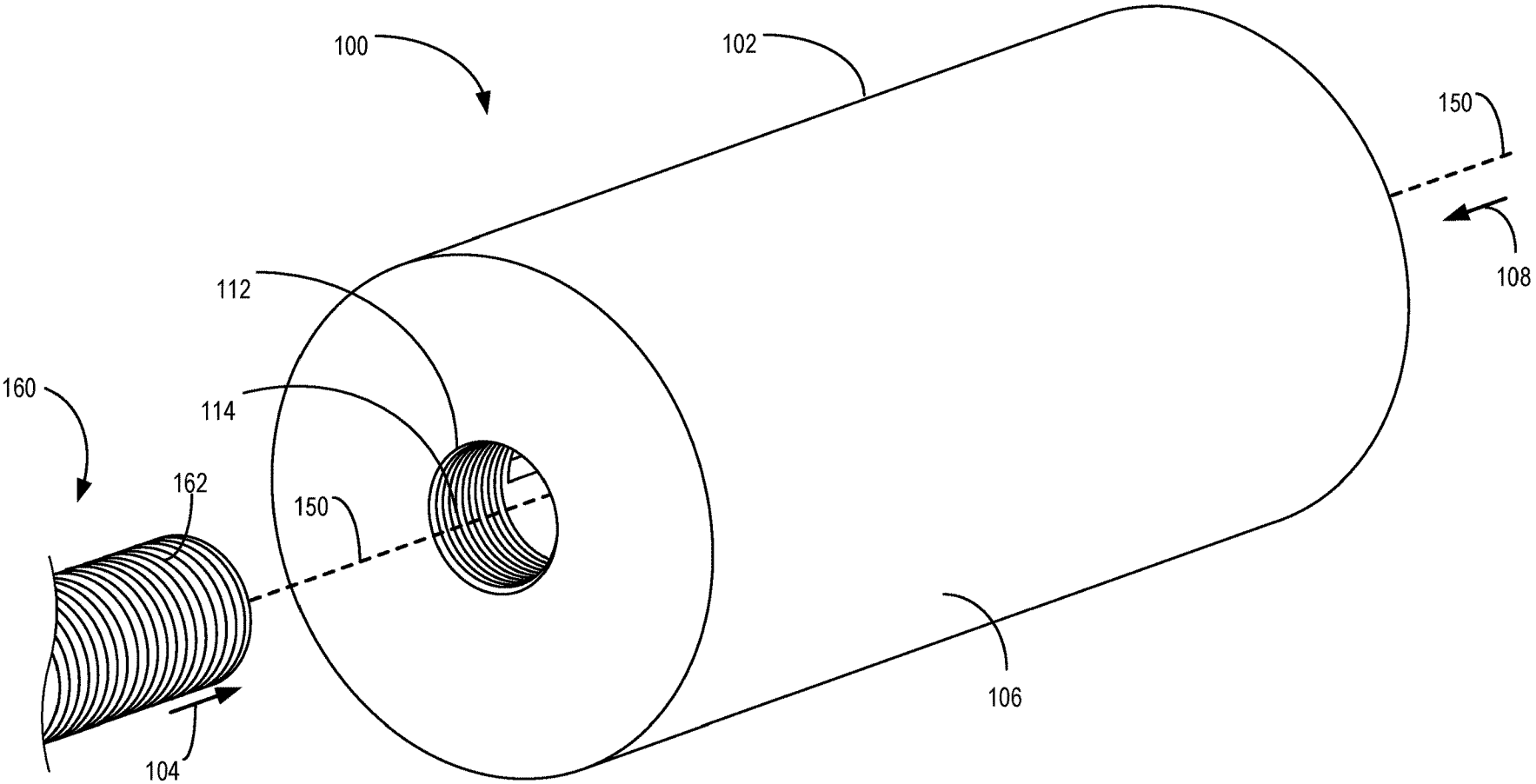
FIG. 1 shows a first perspective view of a suppressor including a gas deflector according to an embodiment of the present disclosure.
Figure 5:
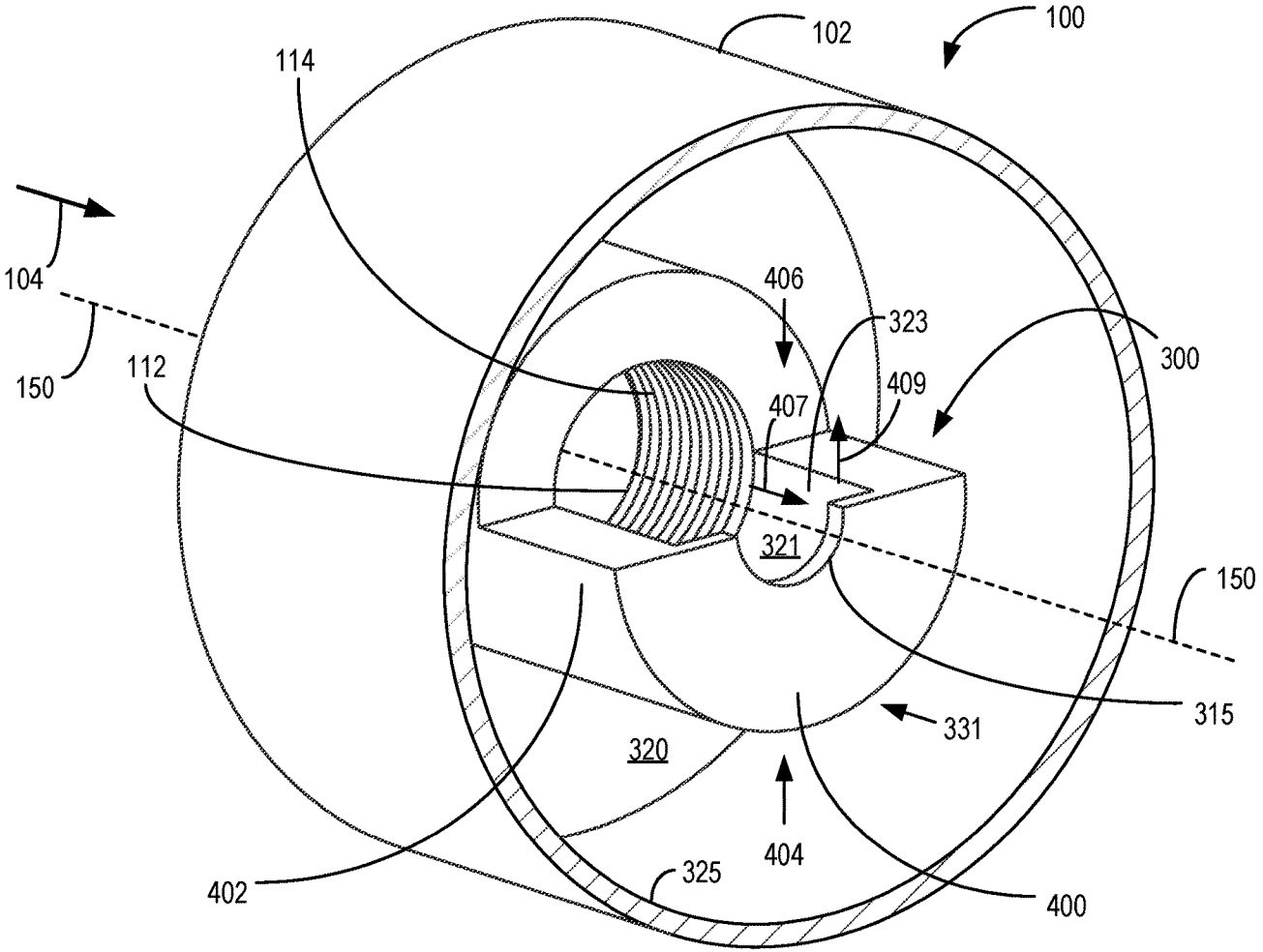
FIG. 5 shows a third sectional view of the suppressor of FIG. 1.
Figure 6:
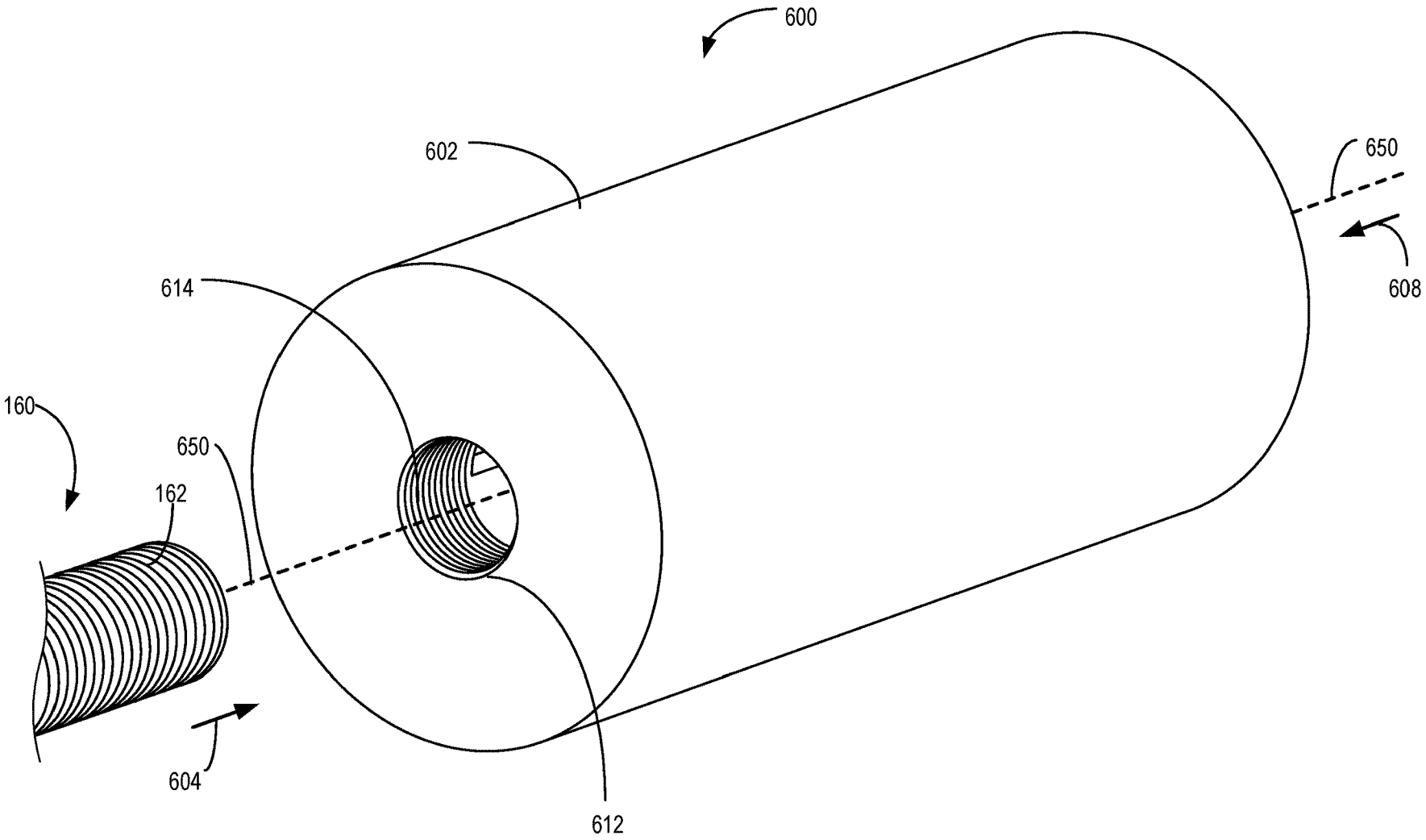
FIG. 6 shows a first perspective view of a suppressor including a gas deflector according to another embodiment of the present disclosure.

The firearm suppressor with gas deflector may be coupled to a firearm, as described with regard to FIGS. 1 and 6. The firearm suppressor with gas deflector may include a central baffle tube, as shown by FIGS. 3-4 and 8-11. In some embodiments, the suppressor may include one or more periphery baffle tubes, as shown by FIGS. 8-14. Embodiments of the suppressor includes a gas deflector, as shown by FIGS. 3-5 and 8-15, configured to deflect gases provided at a projectile entrance of the suppressor. The deflector may deflect gases, such as combustion gases generated by the firearm, away from a path of a projectile through the suppressor. By directing the gases away from the path of the projectile, a gas pressure within the suppressor due to accumulation of gases at one or more baffles within the suppressor may be reduced, and an ability of the suppressor to reduce acoustical emissions of the firearm may be increased.

Configuring the suppressor to include the deflector may provide the suppressor with significant sound reduction gains. The deflector is arranged immediately adjacent to the muzzle (e.g., exhaust end) of the firearm barrel during conditions in which the suppressor is coupled to the firearm. The deflector may occupy a space at a periphery an area in which the gases exhibit incompressible flow boundary layers, which may be referred to as a shock bottle. The deflector may redirect gases expelled by the firearm in order to reduce an amount of noise generated by the gases. In particular, the deflector is configured to redirect gases away from a path of a projectile fired by the firearm through the suppressor (e.g., direct the gases off-axis of a bore of the suppressor). Further, by configuring the suppressor to include a central baffle tube and/or one or more periphery baffle tubes, a space or void within an interior of the suppressor may force the gas to reverse direction prior to flowing out of the suppressor and may further reduce an amount of noise generated by the firearm.

FIGS. 1-15 show the relative positioning of various components of the suppressor assembly. If shown directly contacting each other, or directly coupled, then such components may be referred to as directly contacting or directly coupled, respectively, at least in one example. Similarly, components shown contiguous or adjacent to one another may be contiguous or adjacent to each other, respectively, at least in one example. As an example, components lying in face-sharing contact with each other may be referred to as in face-sharing contact or physically contacting one another. As another example, elements positioned apart from each other with only a space there-between and no other components may be referred to as such, in at least one example.

Elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being triangular, helical, straight, planar, curved, rounded, spiral, angled, or the like). Further, elements shown intersecting one another may be referred to as intersecting elements or intersecting one another, in at least one example. Further still, an element shown within another element or shown outside of another element may be referred as such, in one example. For purpose of discussion, FIGS. 1-15 will be described collectively.

Referring to FIG. 1, an exterior perspective view of a first example suppressor 100 according to an embodiment of the current disclosure is shown. The exterior view of the suppressor 100 is shown in order to illustrate the overall shape of the suppressor and relative spatial positioning. As shown in the figure, the suppressor 100 comprises an elongate tubular casing 102 (which may be referred to herein as a housing), a rearward end 104, an outer surface 106, a forward end 108, and projectile entrance passage 112.

The suppressor 100 of FIG. 1 comprises projectile entrance passage 112 forming a generally annular channel at the rearward end 104 wherethrough a projectile such as a bullet may enter to pass through and exit the suppressor 100 at the forward end 108. The projectile may travel along a central axis 150 of the suppressor 100.

The longitudinally rearward end 104 contains the projectile entrance passage 112, an opening sufficiently large enough to permit passage of at least a portion of a firearm barrel (e.g., firearm barrel 160), where the suppressor 100 may attach via connectable interaction devices such as interlacing threads. For example, suppressor 100 may include threads 114 configured to engage (e.g., interlock) with counterpart threads 162 of firearm barrel 160. Threads are depicted for attaching the suppressor to the firearm in this embodiment, however, other methods of attachment may be used. For example, lugs, external threads on flash hiders, pawls, collets, cross-bolts, clamps, notches, or combinations thereof may be used.

Figure 2:
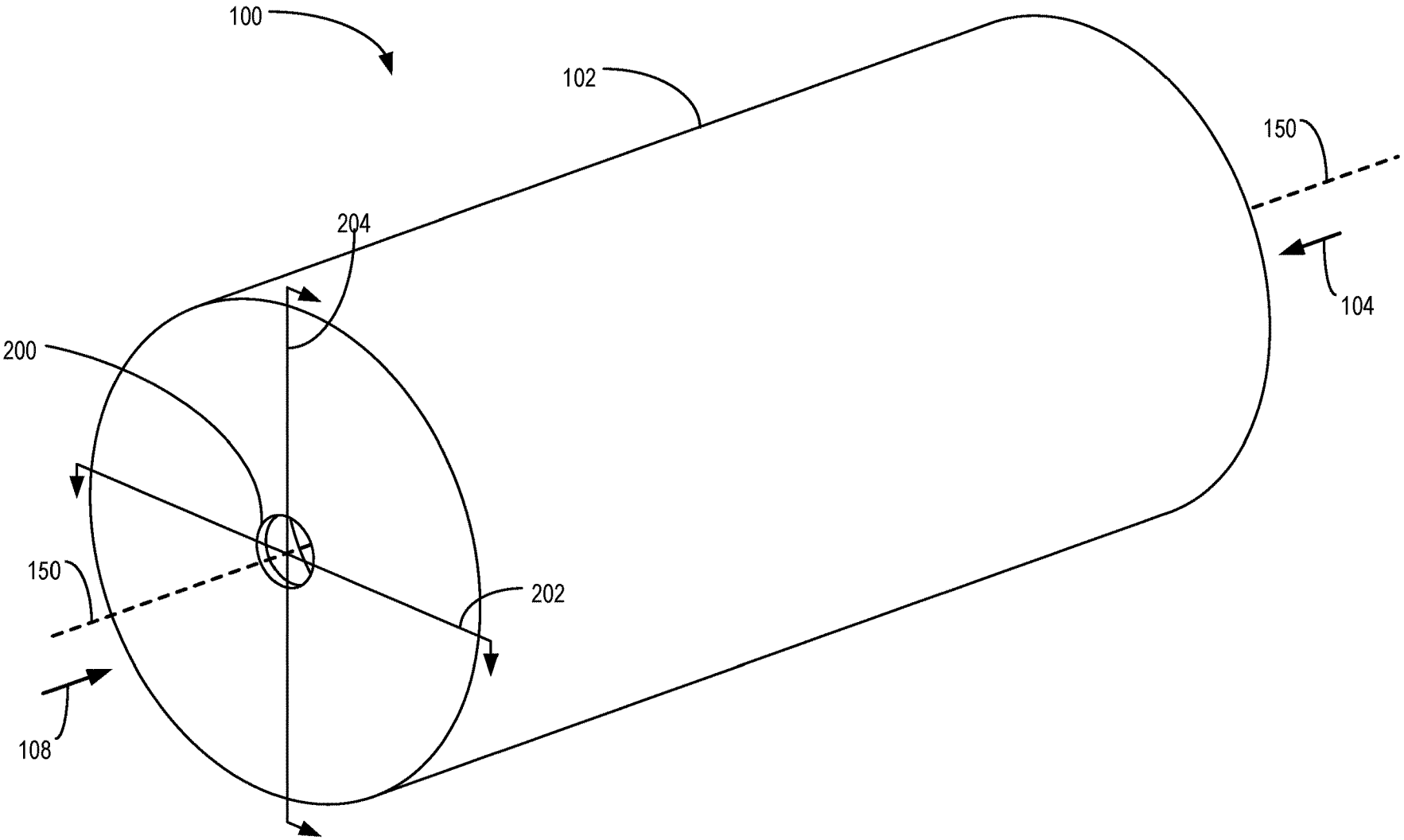
FIG. 2 shows a second perspective view of the suppressor of FIG. 1.

Referring to FIG. 2, a second perspective view of the suppressor 100 is shown. FIG. 2 shows the forward end 108 of the suppressor 100, where the forward end 108 includes a projectile exit passage 200 (which may be referred to herein as a projectile exit). During a firing event of a firearm coupled to the suppressor 100, for example, a projectile fired by the firearm may travel through the suppressor 100 in a direction from the projectile entrance passage 112 at the rearward end 104 toward the projectile exit passage 200 at the forward end 108 (e.g., in a direction of central axis 150 through the suppressor 100).

Figure 3:
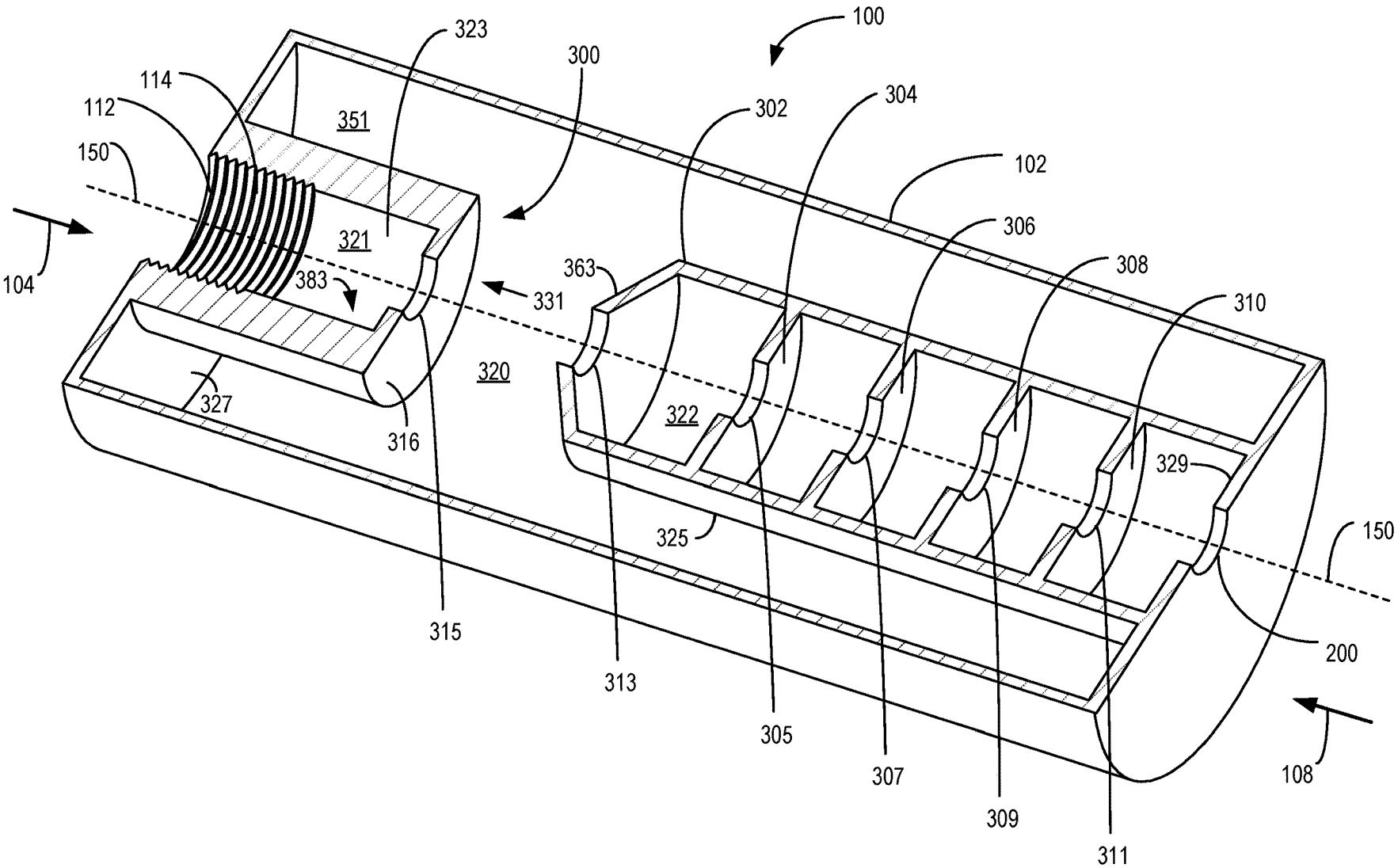
FIG. 3 shows a first sectional view of the suppressor of FIG. 1.
Figure 4:
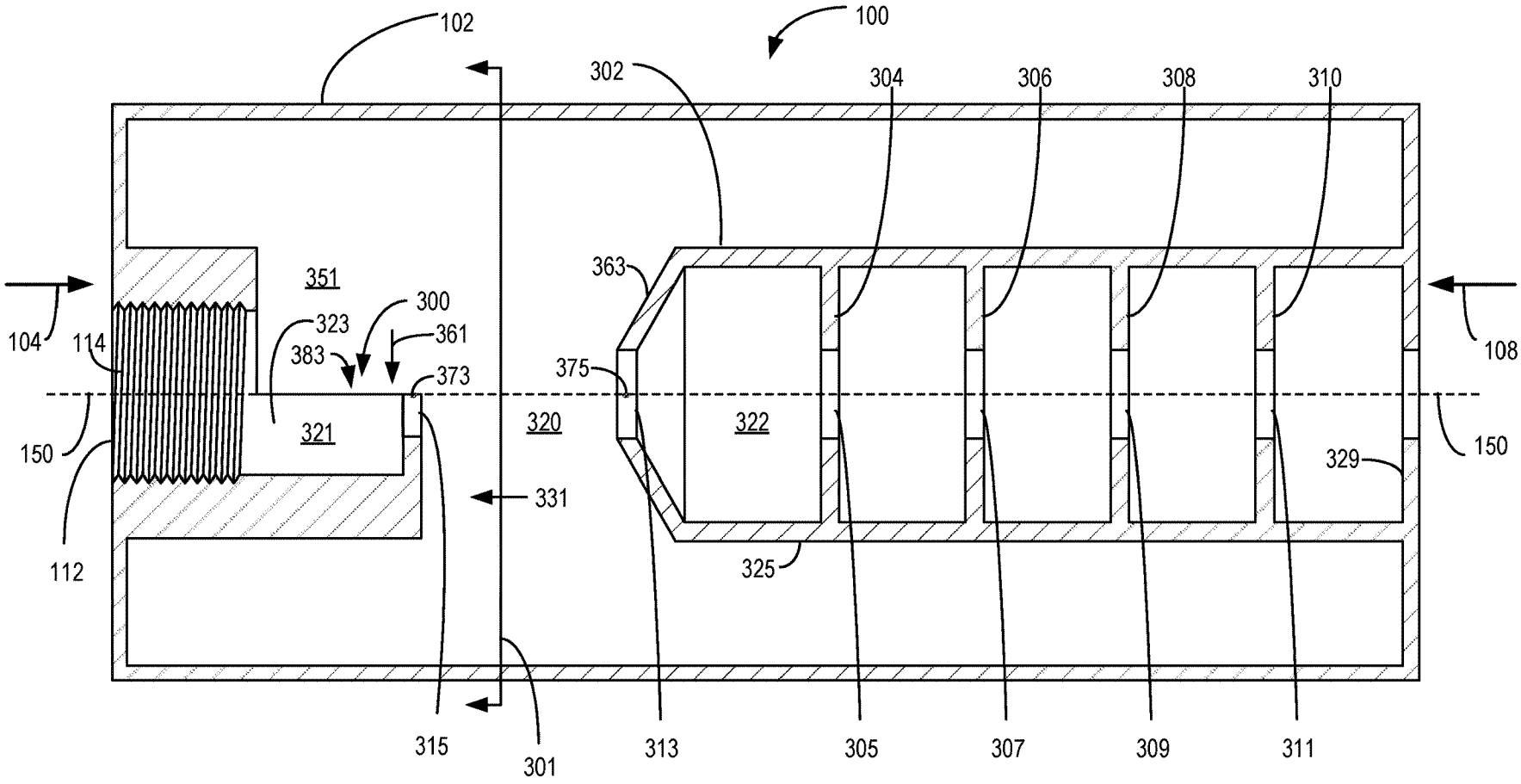
FIG. 4 shows a second sectional view of the suppressor of FIG. 1.

Referring collectively to FIGS. 3-4, sectional views of the suppressor 100 are shown. The sectional view of FIG. 3 may be taken along line 202 shown by FIG. 2, and the sectional view of FIG. 4 may be taken along line 204 shown by FIG. 2. The elongate tubular casing 102 includes a deflector 300 (which may be referred to herein as a gas deflector) and may further comprise a central baffle tube 302. The deflector 300 and central baffle tube 302 are each disposed within an interior 320 of the casing 102, with the deflector 300 arranged toward the rearward end 104 and with the central baffle tube 302 arranged toward the forward end 108. In particular, the deflector 300 is joined to the projectile entrance passage 112 at the rearward end 104, and the central baffle tube 302 is joined to the projectile exit passage 200 at the forward end 108.

As described above, the deflector 300 may deflect gases (e.g., combustion gases resulting from firing of a firearm coupled to the suppressor 100) in a direction away from a path of a projectile through the suppressor 100 (e.g., away from central axis 150 or off-axis). For example, the deflector 300 may deflect gases in a radial direction of the central axis 150 and may at least partially obstruct gases from flowing in the direction parallel with the central axis 150. The deflection of the gases away from the central axis 150 requires the gases to redirect one or more times before entering opening 313 into the baffle tube 302. The deflector 300 includes various surfaces configured to deflect the gases, similar to the examples described further below with reference to the other figures. For example, deflector 300 includes concave cavity 321 formed by interior surface 323 of the deflector 300, with the concave cavity 321 extending in an arc around the central axis 150 and arranged at a side 361 of the deflector 300 facing the central axis 150 (e.g., with opening 383 of the concave cavity 321 facing the central axis 150). In the example shown, the interior surface 323 extends parallel with the central axis 150 and curves concavely around the central axis 150 such that the interior surface 323 has a circular cross-section (e.g., each location along the interior surface 323 is arranged a same distance from the central axis 150 in a radial direction relative to central axis 150). However, in other examples (such as the example shown by FIG. 15 and described below), the interior surface may extend at an angle relative to the central axis and/or may have a different cross-section (e.g., an elliptical cross-section). Further, in the example shown, the interior surface 323 extends around (e.g., arcs around) the central axis 150 by 180 degrees. However, in other examples, the interior surface 323 may extend around the central axis 150 by a different amount (e.g., 150 degrees, 120 degrees, 210 degrees, etc.).

The central baffle tube 302 is arranged along the central axis 150 and includes a plurality of baffles disposed within an interior 322 of the central baffle tube 302. The interior 322 of the central baffle tube 302 may be referred to herein as a baffle chamber and is formed by a cylindrical wall 325 of the casing 102 surrounding distal end wall 329 (where distal end wall 329 is arranged opposite to end wall 327 arranged at rearward end 104). Forward end 108 may be referred to herein as a distal end of the suppressor 100. The cylindrical wall 325 and wall 329 may be joined together (e.g., formed together, molded together, etc. as a single, unitary piece). In the example shown by FIG. 3, the central baffle tube 302 includes a first baffle 304 having a first opening 305, a second baffle 306 having a second opening 307, a third baffle 308 having a third opening 309, and a fourth baffle 310 having a fourth opening 311. The central baffle tube 302 further includes opening 313 arranged opposite to (e.g., across from) an opening 315 of the deflector 300, where the opening 315 of the deflector 300 is arranged opposite to the projectile entrance passage 112 and may have a semi-circular profile (e.g., may be shaped as a half-circle). The central axis 150 intersects a midpoint 373 of the opening 315 and a midpoint 375 of the opening 313. The opening 313 may be referred to herein as a baffle chamber projectile entrance and may be the only entrance of a projectile into the baffle chamber 322. The portion of the interior 320 including the deflector 300 may be referred to herein as a deflector chamber 351. The deflector chamber 351 may include the deflector 300, where the deflector chamber 351 is separated from the baffle chamber 322 by separator wall 363, and where the separator wall 363 is spaced apart from end wall 316 of the deflector 300 arranged at a distal end 331 of the deflector 300 (e.g., with distal end 331 spaced apart from projectile entrance passage 112 in the direction of the central axis 150). Separator wall 363 may be formed together with the cylindrical wall 325 and may be surrounded by the cylindrical wall 325. In this configuration, the opening 313 formed in the separator wall 363 of the central baffle tube 302 connects the baffle chamber 322 to the deflector chamber 351. In other examples, such as the example shown by FIG. 15, the baffles may extend between opposing walls of the suppressor, with the central axis 150 arranged normal to the baffles and with a baffle arranged closest to the deflector 300 (e.g., baffle 1518 in the example shown by FIG. 15) including an opening configured as a baffle chamber projectile entrance (e.g., similar to opening 313). Each of the opening 313 of the central baffle tube 302 and the opening 315 of the deflector may be centered on the central axis 150. Each of the openings of the central baffle tube 302 (e.g., opening 313) may have a circular profile (e.g., shaped as a circle) and may be sized such that a projectile fired by the firearm coupled to the suppressor 100 passes through each of the openings during travel through the suppressor 100 from the rearward end 104 to the forward end 108. However, other embodiments of the openings may have different cross-sectional shapes such as square, irregular, or hexagonal. Each of the baffles may partition a space within the central baffle tube 302 into a plurality of chambers, where the plurality of chambers may restrain and absorb energy of propellant gases generated by the firing of the firearm. For example, the central baffle tube 302, in combination with the deflector 300, may significantly reduce an overall mass flow rate of the exhaust gases (which may be referred to herein as propellant gases and/or combustion gases) of the firearm and therefore reduce the overall energy signatures of the firearm.

Referring to FIG. 5, another sectional view of the suppressor 100 is shown. The sectional view of FIG. 5 may be taken along line 301 shown by FIG. 4. In particular, the sectional view of FIG. 5 shows the deflector 300 arranged within the interior 320 of the suppressor 100 at the rearward end 104 of the suppressor 100. In some examples, the deflector 300 may be formed together within the casing 102 as a single, unitary piece (e.g., a single monolithic structure). For example, the casing 102 and deflector 300 may be formed together (e.g., molded together, machined together, formed integrally in a single piece via additive manufacturing such as three-dimensional (3D) printing, etc.) as a continuous unit from a same material (e.g., metal, such as steel, titanium, etc.) without welding, fasteners, etc. 3D printing may include selective laser melting (SLM), fused deposition modeling (FDM), sterolithography (SLA), laminated object manufacturing (LOM), etc. The suppressor 100 and each structure of the suppressor may likewise be formed (e.g., manufactured) as a monolithic and unitary structure. Further, in some examples the suppressors described herein with reference to FIGS. 6-15 may be manufactured in a similar way (e.g., via additive manufacturing such as 3D printing, etc.).

The deflector 300 includes an end wall 400 arranged opposite to the projectile entrance passage 112 in a direction of the central axis 150. The end wall 400 includes the opening 315 and is maintained in position by support 402. The end wall 400 and support 402 may be formed together (e.g., via additive manufacturing, molding, machining, etc., as described above). The deflector 300 may incur significant force upon firing of the firearm. In some examples, exhaust gas pressure against the deflector 300 may range from 7-30 Ksi, and a mass of the propellant may be between approximately 5 to 500 grains. The support 402 secures the end wall 400 to the casing 102 and maintains the position of the end wall 400 within the casing 102 while the firearm is fired. As a result, the gases expelled by the firearm into the suppressor 100 may flow against the end wall 400 (e.g., in a direction of the central axis 150, indicated by arrow 407) and be forced to change direction upon colliding with the end wall 400. Furthermore, the shape of deflector 300 may form an incompressible region of gases which divert the gases off of the central axis 150. The deflector 300 may be closed to the interior 320 of the suppressor 100 at a first end 404, depicted as the bottom, and open to the interior 320 at a second end 406, depicted as the top, such that gases flowing against the end wall 400 may change direction to flow away from the deflector 300 out of the second end 406 (e.g., in a direction away from the central axis 150, indicated by arrow 409). The gases may then expand into the interior 320 of the suppressor 100 and flow into the central baffle tube 302 (shown by FIGS. 3-4).

In this configuration, gases incident against the deflector 300 (e.g., against the end wall 400 of the deflector 300) may have a reduced energy upon flowing into the interior 320 and/or central baffle tube 302 relative to configurations that do not include the deflector 300. For example, the end wall 400 of the deflector 300 may absorb energy (e.g., kinetic energy) from the gases and reduce an impulse of the gases against other components of the suppressor 100 (e.g., the casing 102). As a result, an amount of noise generated by the gases may be reduced. Further, by altering the direction of the gases away from the path of the projectile through the suppressor 100, a likelihood of gas accumulation within the central baffle tube 302 may be reduced (e.g., an amount of gases remaining in the central baffle tube 302 may be reduced and an amount of gases flowing out of the central baffle tube 302 via the projectile exit passage 200 may be increased). The deflector 300 shown by FIGS. 3-5 may be similar to, or the same as, deflector 300 described in further embodiments below and may provide noise reduction that is similar to, or the same as, the noise reduction provided by deflectors of other embodiments. Although the suppressor 100 is shown including the central baffle tube 302 in FIGS. 3-4, in some embodiments the suppressor may not include the central baffle tube 302. For example, the suppressor 100 may include a plurality of baffles extending between opposing sides of the suppressor 100 within the interior 320, where the plurality of baffles are not disposed within a tube such as the central baffle tube 302 (e.g., similar to the example shown by FIG. 15 and described further below).

Figure 7:
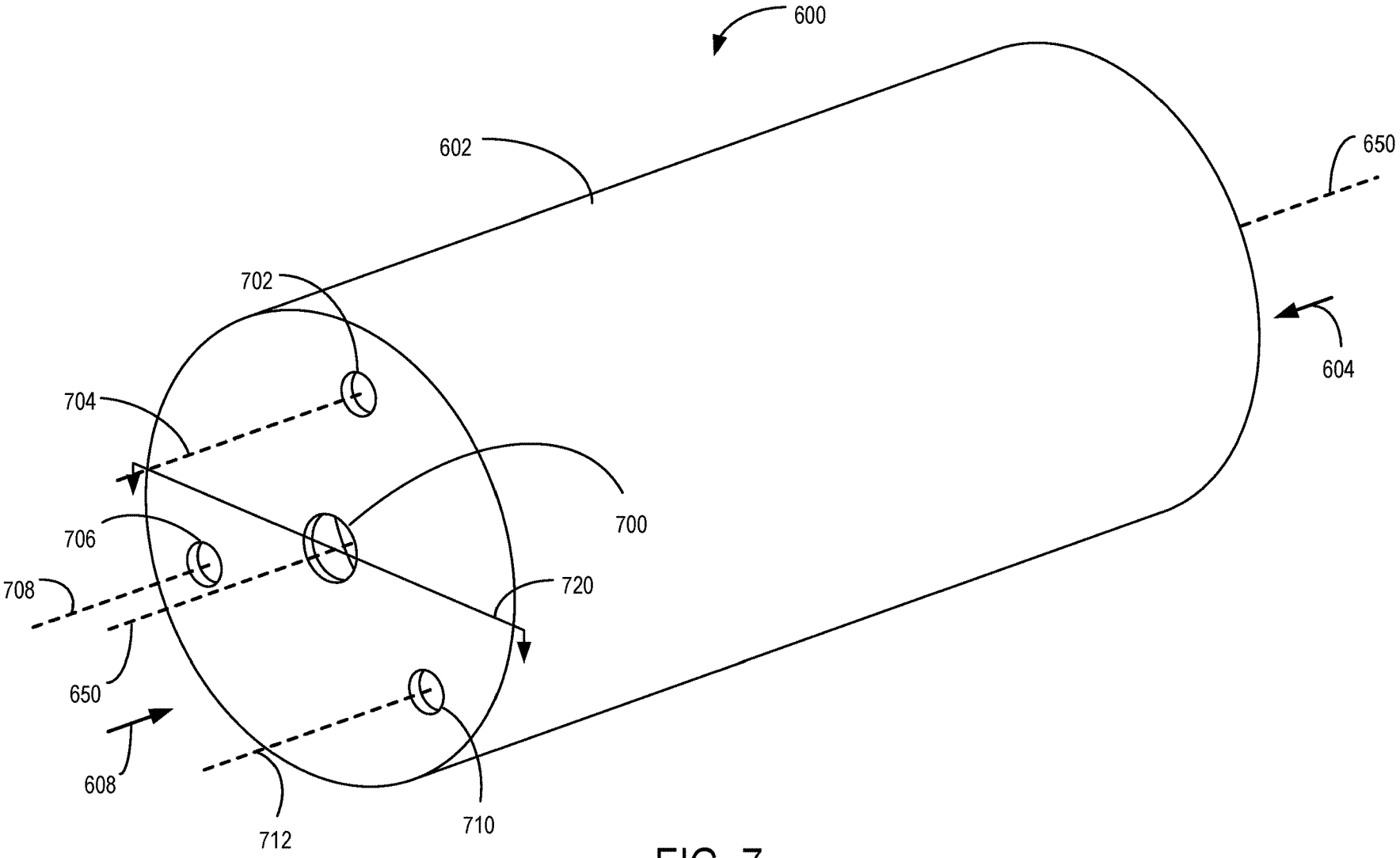
FIG. 7 shows a second perspective view of the suppressor of FIG. 6.

Referring collectively to FIGS. 6-7, different perspective views of a suppressor 600 in accordance with the present disclosure are shown. Suppressor 600 includes several features and components that may be similar to, or the same as, the features and components described above with reference to suppressor 100. In particular, suppressor 600 includes a projectile entrance passage 612 arranged at a rearward end 604 and a projectile exit passage 700 arranged at a forward end 608, with a central axis 650 of the suppressor 600 extending between the projectile entrance passage 612 and the projectile exit passage 700. The projectile entrance passage 612, projectile exit passage 700, rearward end 604, forward end 608, and central axis 650 may be similar to, or the same as, the projectile entrance passage 112, projectile exit passage 200, rearward end 104, forward end 108, and central axis 150, respectively, described above. Further, suppressor 600 may include threads 614 shaped to engage with counterpart threads of a barrel of a firearm for mounting of the suppressor 600 to the firearm, similar to, or the same as, the threads 114 described above. For example, threads 614 of suppressor 600 may engage with counterpart threads 162 of firearm barrel 160.

As shown by FIG. 7, the suppressor 600 includes a plurality of openings configured to flow gases (e.g., combustion gases from firing of the firearm) out of the suppressor 600. In particular, the suppressor 600 includes first opening 702 arranged along axis 704, second opening 706 arranged along axis 708, and third opening 710 arranged along axis 712. The first opening 702, the second opening 706, and the third opening 710 are each spaced apart from the projectile exit passage 700 radially relative to the central axis 650. The openings may increase a flow rate of gases out of the suppressor 600, which may increase a performance of the suppressor 600 (e.g., reduce a likelihood of accumulation of gases within the suppressor 600 and/or reduce an amount of noise generated by the firearm, as described below).

Figure 8:
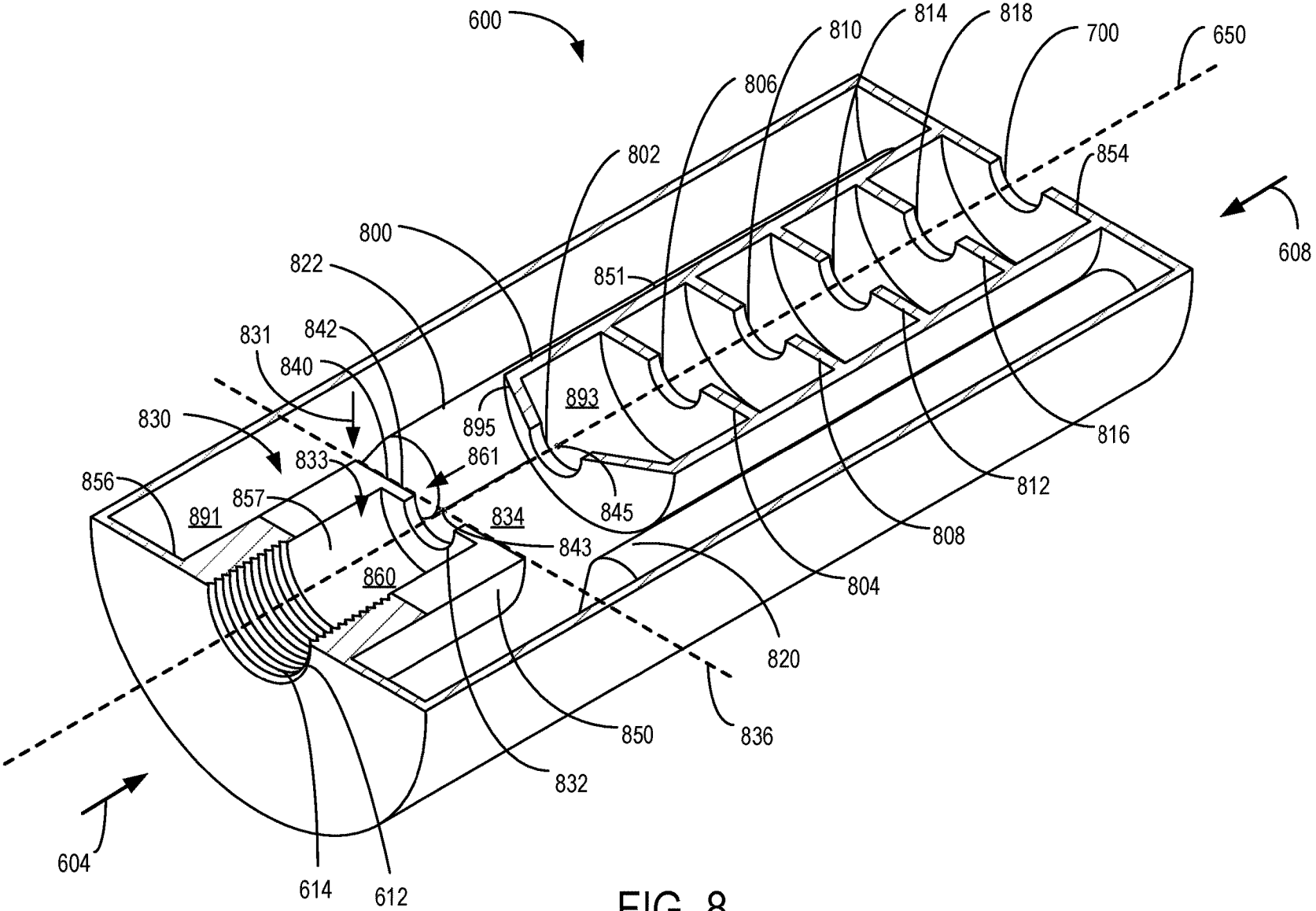
FIG. 8 shows a first sectional view of the suppressor of FIG. 6.

Referring to FIG. 8, a sectional view of the suppressor 600 is shown. The sectional view of FIG. 8 may be taken along line 720 shown in FIG. 7. In the example shown, the suppressor 600 includes a central baffle tube 800 including a plurality of baffles, where each baffle includes a respective opening. During conditions in which the suppressor 600 is coupled to a firearm and a projectile is fired from the firearm, the projectile may travel through the suppressor 600 along the central axis 650 of the suppressor 600 and through each opening of each baffle of the central baffle tube 800. The central baffle tube 800 may be similar to, or the same as, the central baffle tube 302 described above. In particular, central baffle tube 800 includes opening 802, first baffle 804 having first opening 806, second baffle 808 having second opening 810, third baffle 812 having third opening 814, and fourth baffle 816 having fourth opening 818, similar to, or the same as, the opening 313, first baffle 304 having first opening 305, second baffle 306 having second opening 307, third baffle 308 having third opening 309, and fourth baffle 310 having fourth opening 311, respectively, described above. The opening 802 may be referred to herein as a baffle chamber projectile entrance.

Figure 9:
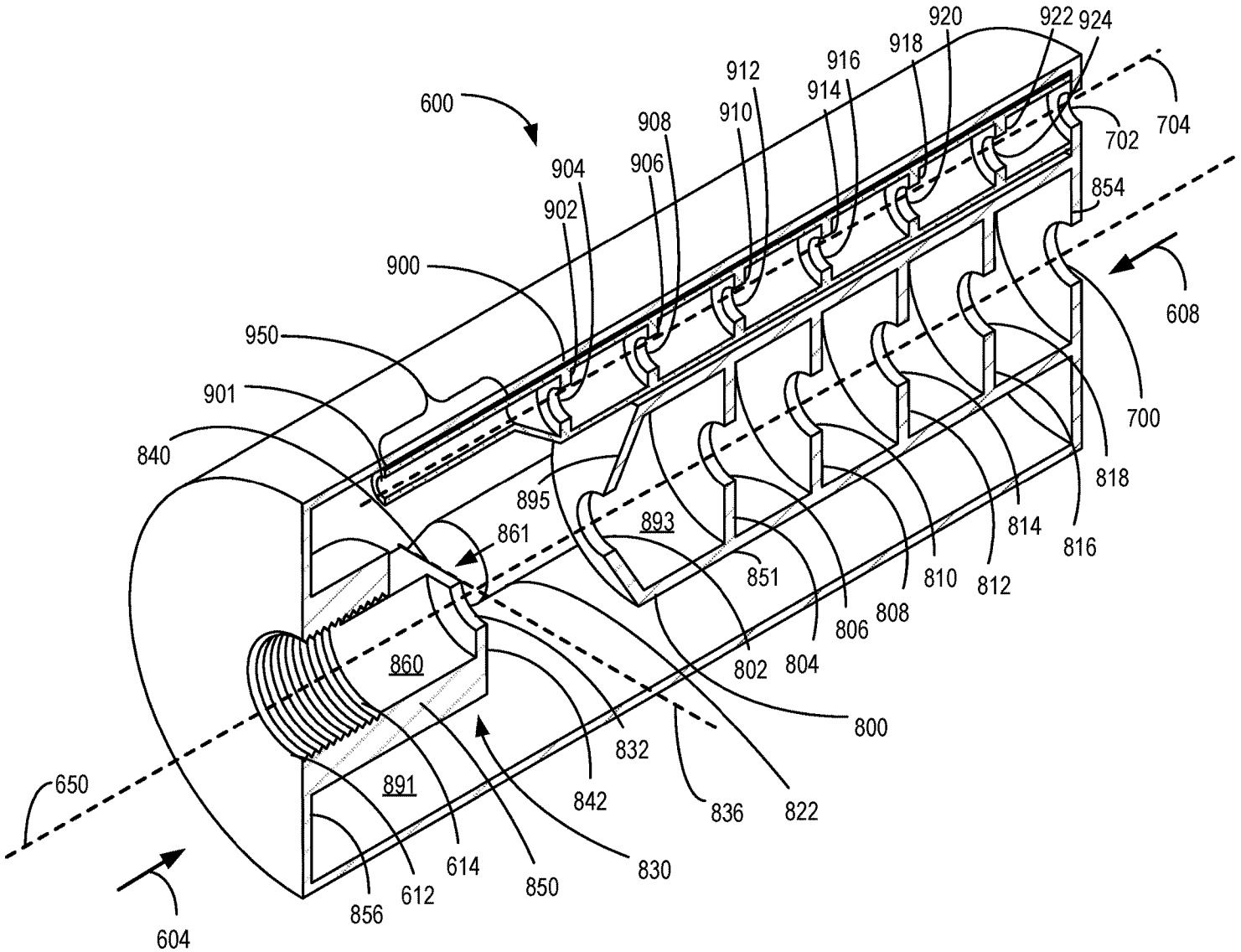
FIG. 9 shows a second sectional view of the suppressor of FIG. 6.
Figure 10:
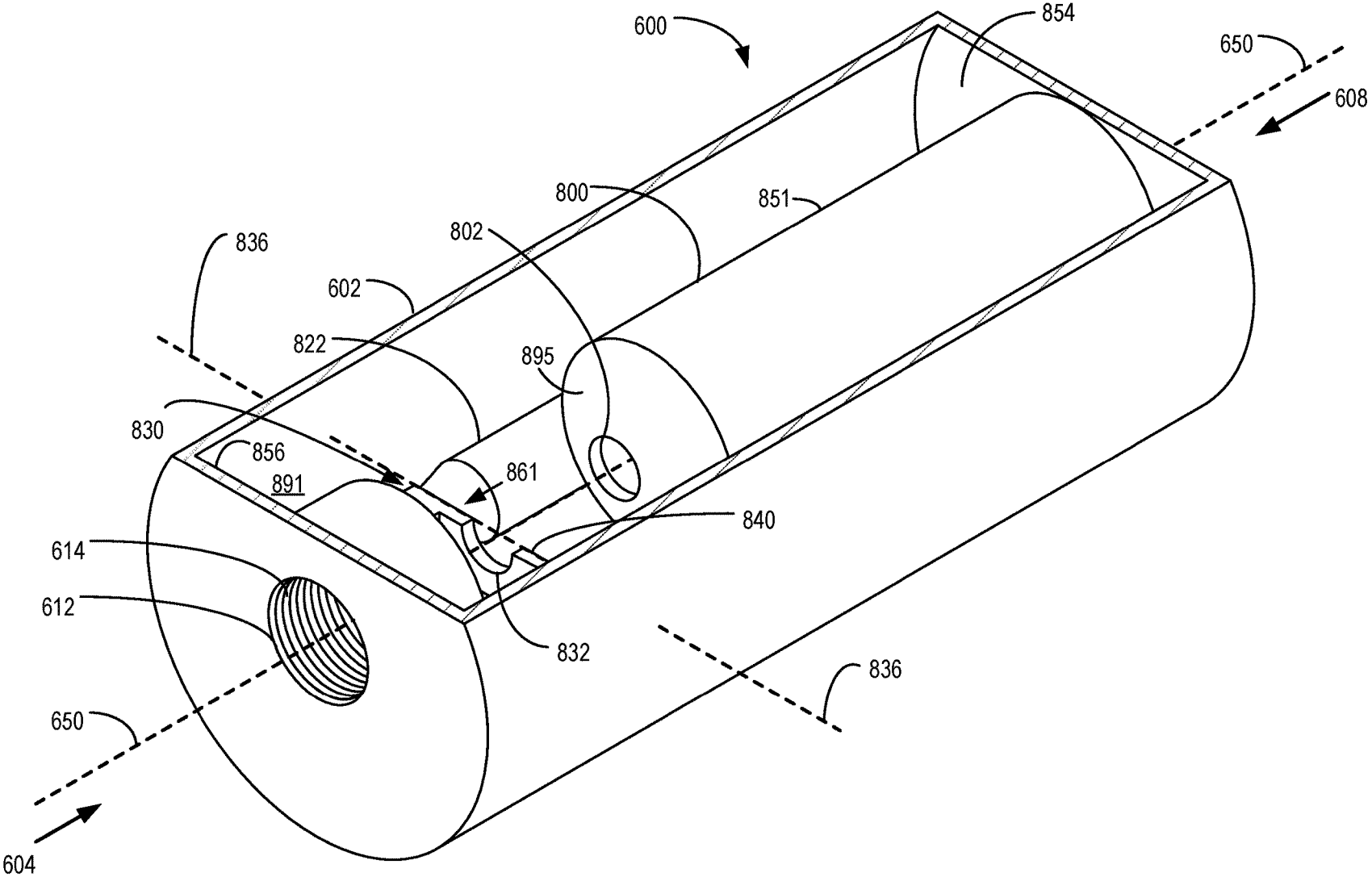
FIG. 10 shows a third sectional view of the suppressor of FIG. 6.

In the example shown, the suppressor 600 further includes a plurality or periphery baffle tubes arranged around the central baffle tube 800 and joined to the casing 602 (e.g., formed together with the casing 602). Each periphery baffle tube is spaced apart from the central baffle tube 800 radially relative to the central axis 650. In particular, the suppressor 600 includes a first periphery baffle tube 900 (shown by FIG. 9) forming first opening 702 described above, a second periphery baffle tube 820 (shown by FIG. 8) forming second opening 706 described above, and a third periphery baffle tube 822 (shown by FIG. 8) forming third opening 710 described above. Each periphery baffle tube may be smaller than the central baffle tube 800 and may include a respective plurality of baffles configured to absorb energy (e.g., kinetic energy, thermal energy, etc.) from combustion gases flowing into the suppressor 600 from the firearm. For example, FIG. 9 shows a sectional view of the suppressor 600 showing an interior of the first periphery baffle tube 900. First periphery baffle tube 900 includes opening 901, baffle 902 having opening 904, baffle 906 having opening 908, baffle 910 having opening 912, baffle 914 having opening 916, baffle 918 having opening 920, and baffle 922 having opening 924. Each other periphery baffle tube (e.g., second periphery baffle tube 820 and third periphery baffle tube 822) may have a similar configuration. The periphery baffle tubes may further include a narrow section, such as narrow section 950 of first periphery baffle tube 900 shown by FIG. 9, located on the side of the projectile entrance passage 612 of the suppressor 600. The narrow section may have a smaller diameter than the remainder of the periphery baffle tubes (e.g., the diameter of the first periphery baffle tube 900 at narrow section 950 is smaller than a diameter of other portions of the first periphery baffle tube 900). This narrower section may be referred to as a chimney. The periphery baffle tubes may extend from a distal end wall 854 of the suppressor 600 towards an opposing end wall 856. The openings to the periphery baffle tubes, such as opening 901, may extend past the opening 802 to the central baffle tube 800, and opening 832 of an end wall 842 of the deflector, as depicted in FIG. 11.

Referring collectively to FIGS. 8-14, various sectional views of the suppressor 600 are shown, where the suppressor 600 includes a deflector 830 (which may be referred to herein as a gas deflector) configured to direct gases provided to the suppressor 600 by a firearm away from a path of a projectile fired by the firearm through the suppressor 600. The deflector 830 may be similar to, or the same as, the deflector 300 described above. Deflector 830 includes opening 832 arranged opposite to the projectile entrance passage 612 along the central axis 650. During conditions in which the suppressor 600 is coupled to a firearm (e.g., a rifle) and a projectile (e.g., a bullet) is fired from the firearm through the suppressor 600, the projectile travels through both of the projectile entrance passage 612 and the opening 832 along the central axis 650. The central axis 650 intersects a midpoint 843 of opening 832 and a midpoint 845 of the opening 802. The opening 832 may have a semi-circular profile (e.g., may be shaped as a half-circle) and may open to an interior 834 of the suppressor 600. However, in other examples, the opening 832 may have a different shape profile (e.g., rectangular, triangular, hexagonal, etc.). The portion of the interior 834 including the deflector 830 may be referred to herein as a deflector chamber 891. The deflector chamber 891 may include the deflector 830, where the deflector chamber 891 is separated from baffle chamber 893 by separator wall 895. In some examples, such as the example shown by FIG. 15, the baffle chamber may include baffles that extend between opposing walls of the suppressor, with the central axis 650 arranged normal to the baffles. The opening 802 formed by the separator wall 895 connects the baffle chamber 893 with the deflector chamber 891. The baffle chamber 893 is formed by (e.g., surrounded by) a cylindrical wall 851, where the cylindrical wall 851 surrounds distal end wall 854 at forward end 608. Separator wall 895 may be formed together with the cylindrical wall 851 and may be surrounded by the cylindrical wall 851. Forward end 608 may be referred to herein as a distal end of the suppressor 600. The cylindrical wall 851 and distal end wall 854 may be joined together (e.g., formed together, molded together, etc. as a single, unitary piece).

The end wall 842 of the deflector 830 is arranged at a distal end 861 of the deflector 830, where the distal end 861 is opposite to the projectile entrance passage 612 in the direction of the central axis 650 (e.g., distal end 861 is spaced apart from the projectile entrance passage 612 in the direction parallel with the central axis 650). A midpoint of the opening 832 may be intersected by each of axis 836 and the central axis 650, where the axis 836 is arranged orthogonal to the central axis 650 and extends parallel with (e.g., coaxial with) an upper edge 840 of end wall 842 of the deflector 830 disposed within the interior 834 of the suppressor 600.

Figure 11:
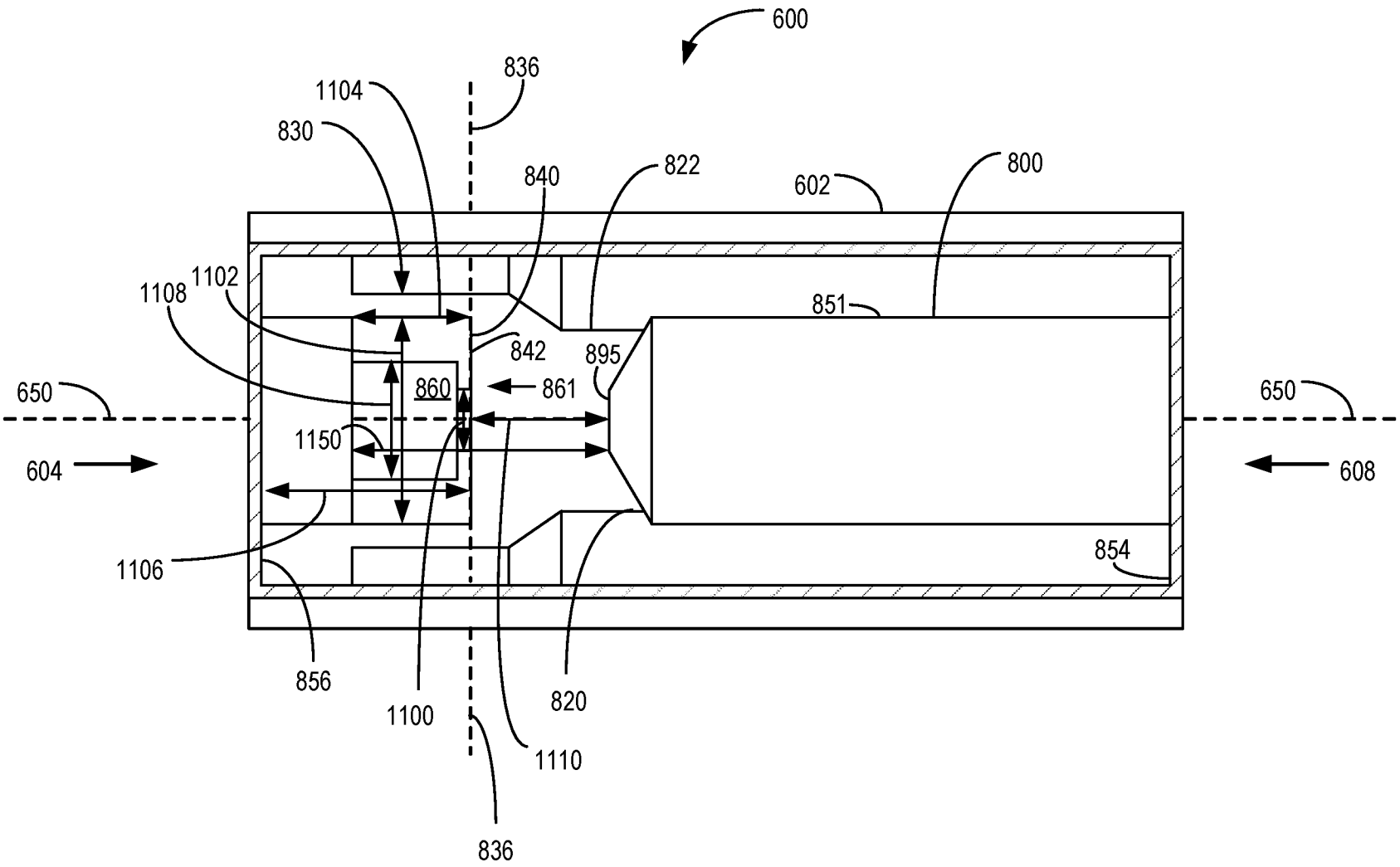
FIG. 11 shows a fourth sectional view of the suppressor of FIG. 6.
Figure 12:
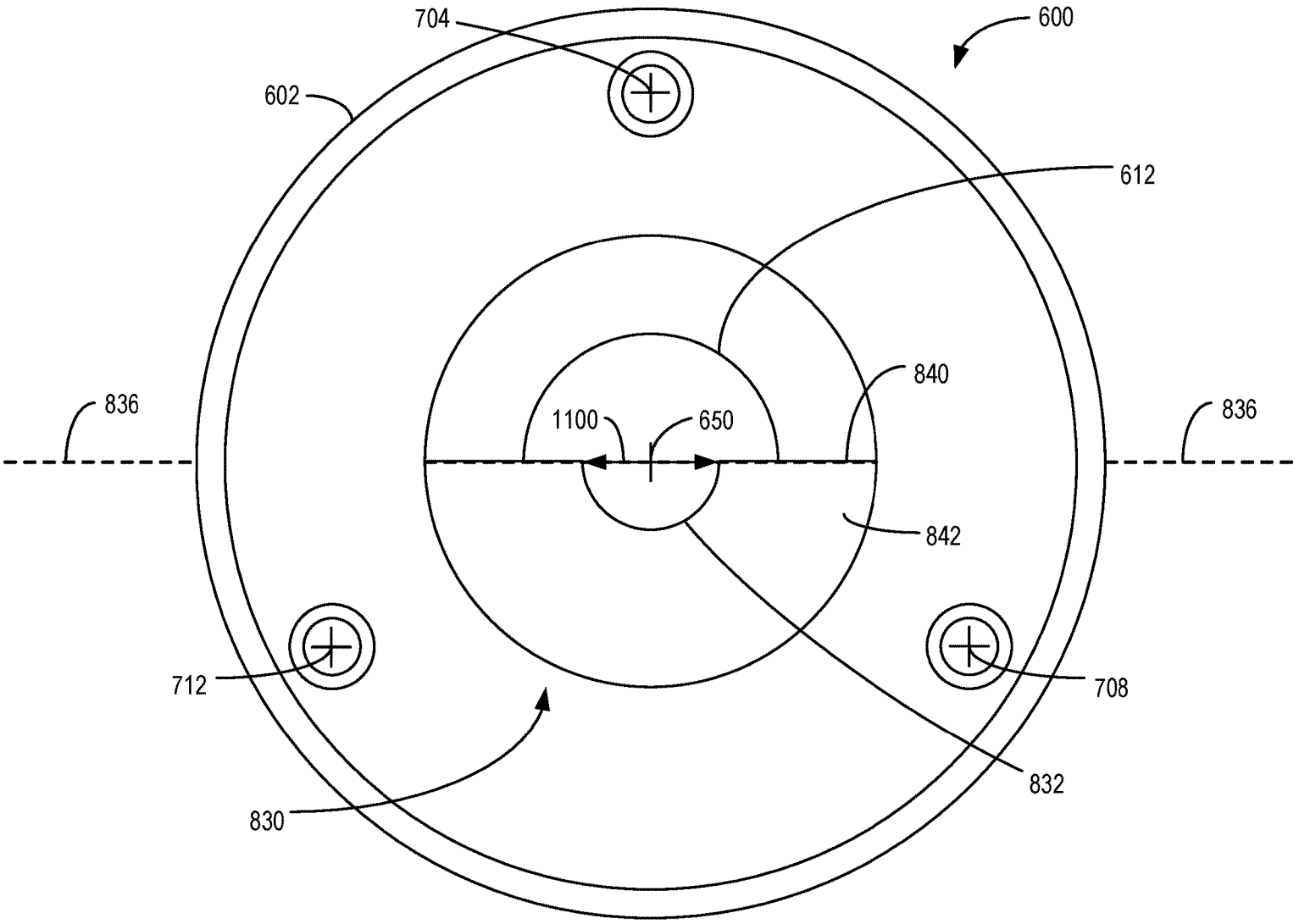
FIG. 12 shows a fifth sectional view of the suppressor of FIG. 6.

As shown by FIG. 11, a length 1100 of the opening 832 in the direction of the axis 836 (e.g., parallel with the axis 836) is less than a length 1102 of the upper edge 840 (e.g., where the length 1102 of the upper edge 840 is a diameter of the deflector 830, from edge 1320 to edge 1322). Further, the deflector 830 includes a chamber 860 (e.g., a hollow or void, which may be referred to herein as a concave cavity) formed by a support 850 of the deflector 830, where the support 850 has a partially cylindrical shape (e.g., the support 850 is shaped as a half-cylinder) formed around (e.g., curved around, arced around, etc.) the central axis 650 such that opening 833 of the chamber 860 faces the central axis 650. In some examples, however, the support 850 may have a different shape (e.g., a shape formed by a plurality of angled surfaces, as in the example shown by FIG. 15). The portion of the interior 834 of the suppressor 600 at which the chamber 860 is arranged may be referred to herein as the deflector chamber, with the deflector 830 cantilevered outward from end wall 856 into the deflector chamber. In this configuration, the concave shape of the support 850 around the central axis 650 forms the chamber 860 at least partially defined by a curved interior surface 857 of the deflector 830 and extending in an arc around the central axis 650. In the example shown, the curved interior surface 857 extends around (e.g., arcs around) the central axis 650 by 180 degrees. However, in other examples, the curved interior surface 857 may extend around the central axis 650 by a different amount (e.g., 150 degrees, 120 degrees, 210 degrees, etc.).

The chamber 860 is arranged at a side 831 of the deflector 830 facing the central axis 650. The chamber 860 is disposed at the central axis 650 and is partially closed by the end wall 842, where the end wall 842 is arranged distal from the projectile entrance passage 612 (which may be referred to herein as a projectile entrance) such that the central axis 650 extends in a direction parallel to a normal of the end wall 842 (e.g., a direction orthogonal to the end wall 842). However, the chamber 860 is not closed to the opening 832 by the end wall 842. Similar to the example of deflector 300 described above, the support 850 is formed integrally with deflector 830 and is not a separate component relative to deflector 830 (e.g., the deflector 830 is a single, unitary piece comprising the support 850 and end wall 842, with the end wall 842 joined to the support 850). Likewise, the suppressor 600 may be formed as single, unitary piece including all of the structures described.

The deflector 830 extends in the direction parallel with the central axis 650, with the support 850 having a partially cylindrical shape curving around the central axis 650 as described above. A length 1104 of the support 850 in the direction of the central axis 650 (e.g., parallel with the central axis 650) may be at least half of a length from end wall 856 to end wall 842 in the direction of the central axis 650. Further, a length 1108 of the chamber 860 in a direction orthogonal to the central axis 650 (e.g., parallel with axis 836) may be at least half of the overall length 1102 of the deflector 830 in the direction orthogonal to the central axis 650 (e.g., where the length 1102 is the length of the upper edge 840 as described above). Further, the overall length 1104 of the deflector 830 in the direction of the central axis 650 may be greater than a length 1110 between the end wall 842 and the central baffle tube 800 (e.g., length 1110 extends between the end wall 842 and the opening 802, shown by FIG. 10, of the central baffle tube 800). The length 1104 of the deflector 830 may also described as the length between the end of the threads 614 and end wall 842. The length 1104 of the deflector may be between 40-80% of a sum of the length 1104 of the deflector 830 with the length 1110 between the end wall 842 and the opening 802. In other words, the length 1104 of the deflector 830 may be between 40-80% of a total length 1150 from the projectile entrance side of the deflector 830 to opening 802 of the baffle tube 800. In other embodiments, the length 1104 of the deflector may be approximately 60% of the total length 1150 or between 50-70% of the total length 1150. Although the deflector 830, including support 850, has the partially cylindrical shape as described above, in other examples the deflector 830 may have a different shape (e.g., one or more angled surfaces) that curves around the central axis 650.

Figure 13:
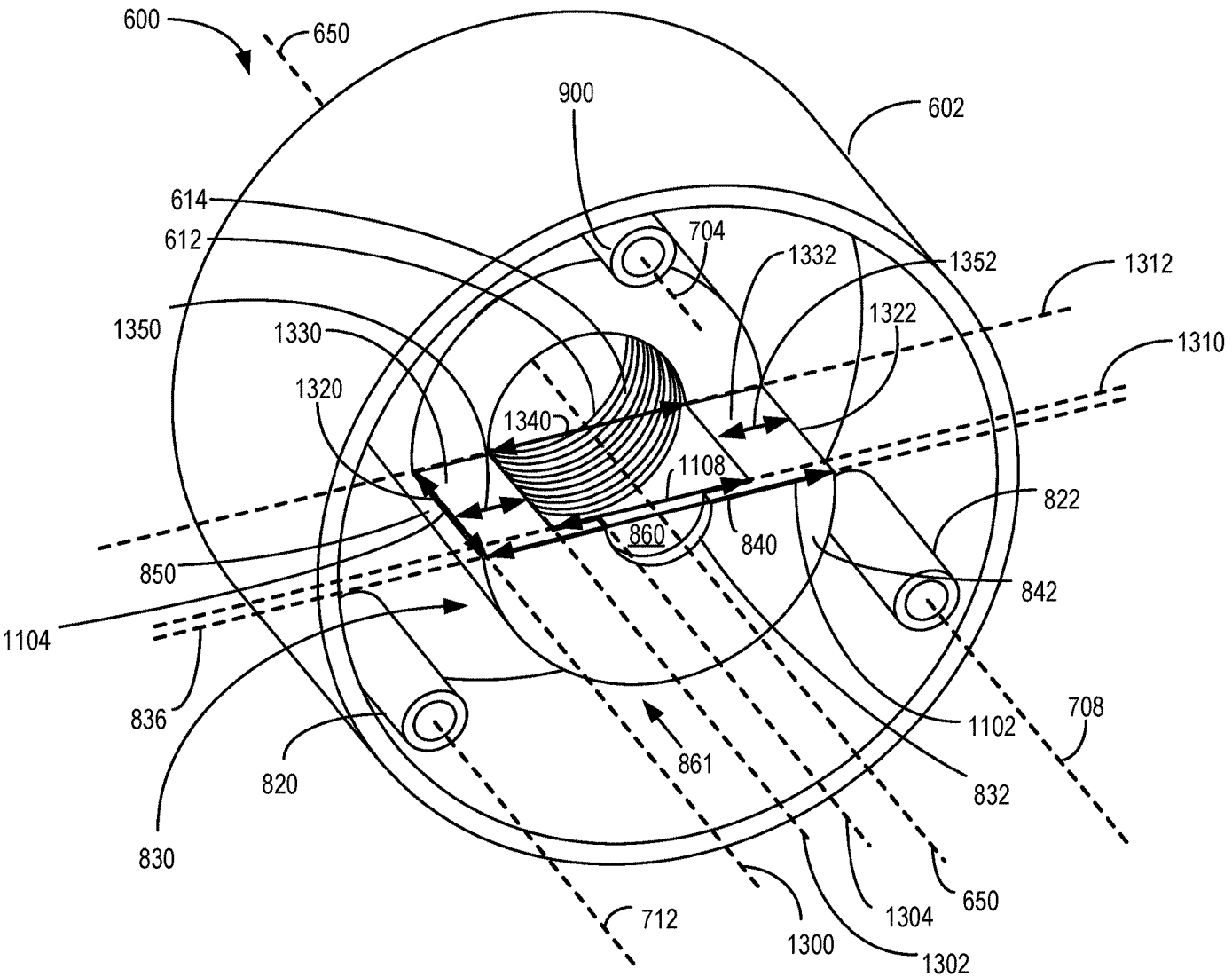
FIG. 13 shows a sixth sectional view of the suppressor of FIG. 6.

Referring to FIG. 13, various axes are shown to illustrate the arrangement of the deflector 830 relative to other components of the suppressor 600, as well as to illustrate the arrangement of each portion of the deflector 830 relative to each other portion of the deflector 830. In particular, FIG. 13 shows axis 1300, axis 1302, and axis 1304 each arranged parallel with the central axis 650, and axis 836, axis 1310, and axis 1312 each arranged parallel with each other and orthogonal (e.g., perpendicular) to the central axis 650.

In the configuration shown, axis 1312 is arranged at an edge of the support 850 opposite to the upper edge 840 in the direction of the central axis 650 and axis 836 is arranged parallel with the upper edge 840 and extends along the upper edge 840. The length 1104 of the support 850 in the direction of the central axis 650, as described above, extends between the axis 1312 and the axis 836 and is parallel with the central axis 650. The end wall 842 has a thickness defined by a length between the axis 836 and the axis 1310 in the direction of the central axis 650, where the axis 836 is arranged at the upper edge 840 as described above and the axis 1310 is offset from the upper edge 840 in a direction toward the projectile entrance passage 612. The thickness of the end wall 842 (e.g., the length between the axis 836 and the axis 1310 in the direction of central axis 650) may vary with structural requirements as dictated by the forces of the propellant gases.

The dimensions described above may vary with a diameter of the projectile. For example, the length 1100 of the opening 832 may be the projectile diameter plus a tolerance. The tolerance may vary from 0.01-0.1 inches. In some specific embodiments, the tolerance may be 0.03 or 0.04 inches. The length 1104 of the support 850 may vary between 200-300% of the diameter of the projectile. In some specific embodiments, the length 1104 of the support 850 may be 250% of the diameter of the projectile. Embodiments of the length 1106 from the end wall 842 of the support 850 to the interior of the end wall 856 of the housing is the length 1104 plus a thread length. Specific embodiments of a thread length may be approximately 0.625 inches but may vary by 0.2 inches. The length 1108 of the chamber 860 may also vary with projectile diameter. The length 1108 of the chamber 860 may be between 150-300% of the projectile diameter, with specific embodiments being 200% of the projectile diameter. The length 1110 between the end wall 842 and the opening 802 may likewise vary with projectile diameter. The length 1110 may vary between 100-300% of the projectile diameter, and specific embodiments of the length 1110 are 150% of the projectile diameter. The exemplary dimensions listed above may each include a tolerance varying from 0.01-0.1 inches and specific examples of 0.03 or 0.04 inches. The exemplary dimensions listed above are exemplary in nature, and that these specific embodiments or examples are not to be considered in a limiting sense, because numerous variations are possible.

As described above, the support 850 has a semi-cylindrical shape in the example shown (although in other examples, the support may have a different shape and/or may be formed by a plurality of angular surfaces partially encircling the central axis 650). The support 850 forms a first upper surface 1330 and a second upper surface 1332, with the first upper surface 1330 arranged opposite to the second upper surface 1332 across the central axis 650. The first upper surface 1330 and the second upper surface 1332 each form a respective portion of the end wall 842 and the upper edge 840. The length 1108 of the chamber 860 in the direction orthogonal to the central axis 650 corresponds to (e.g., is the same as) a length 1340 between the first upper surface 1330 and the second upper surface 1332 in the orthogonal direction. The length 1340 and the length 1108 are each smaller than the overall length 1102 of the support 850 in the orthogonal direction, with the length 1100 of the opening 832 (shown by FIG. 12) being smaller than each of the length 1340 and the length 1108 (e.g., the length 1108 of the chamber 860 in the direction orthogonal to the central axis 650 is greater than the length 1100 of the opening 832 through the end wall 842 in the orthogonal direction).

Figure 14:
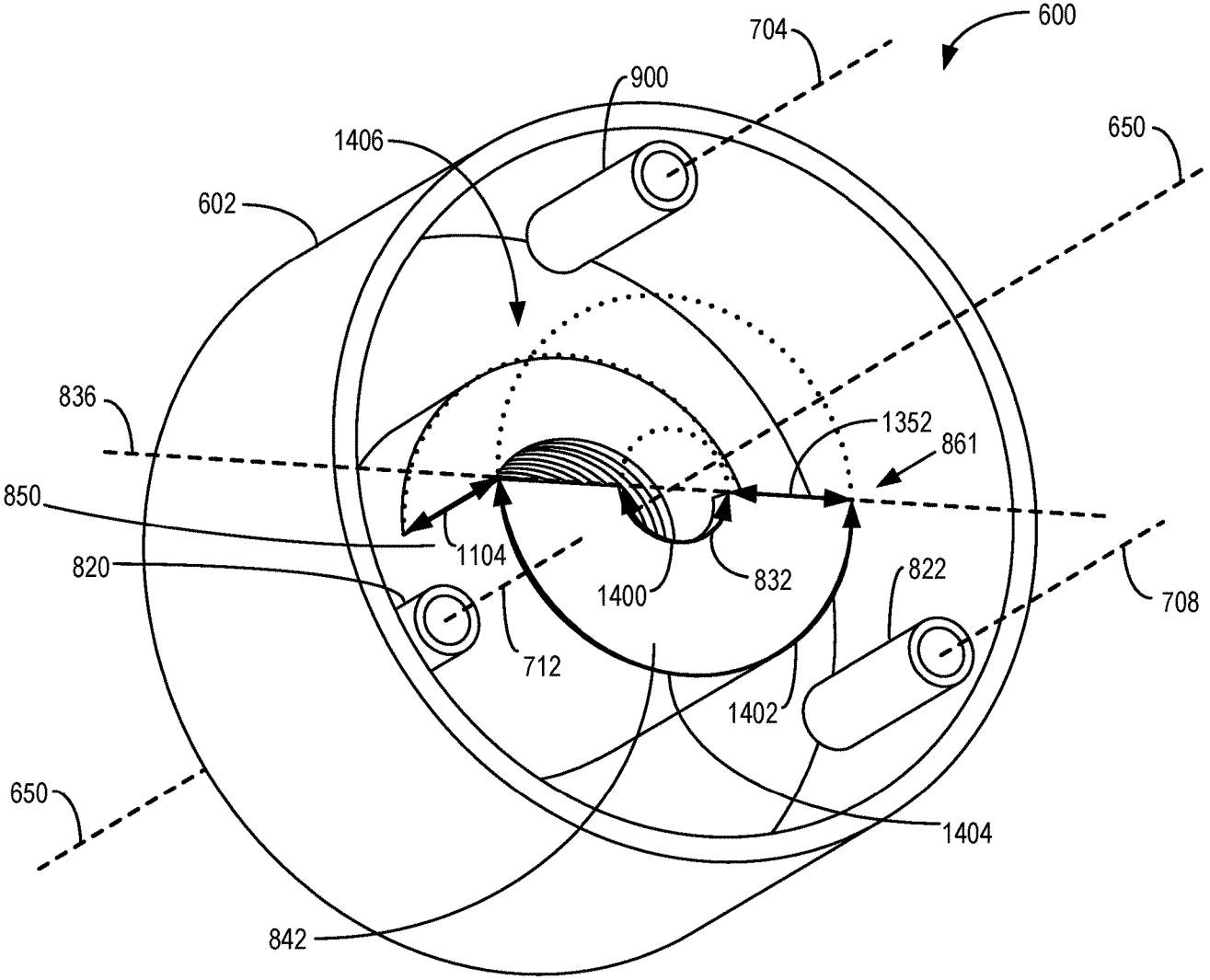
FIG. 14 shows a seventh sectional view of the suppressor of FIG. 6.

Embodiments of a length 1350 of the first upper surface 1330 in the direction orthogonal to the central axis 650 (e.g., the direction parallel with axis 836) is the same as a length 1352 of the second upper surface 1332 in the orthogonal direction of the central axis 650. The first upper surface 1330 and second upper surface 1332 may each be relatively flat, planar surfaces that are arranged parallel and coplanar relative to each other. Each of the length 1350 and the length 1352 are smaller (e.g., a smaller amount of length) than the length 1108 of the chamber 860 in the orthogonal direction. The length 1350 and the length 1352 may each correspond to a thickness of the partial cylindrical profile of the support 850 (e.g., the portion of the support 850 curving around the central axis 650), where a fully cylindrical profile is indicated by dotted lines 1406 in FIG. 14. As shown by FIG. 14, the opening 832 has a first arcuate length 1400 around the central axis 650, and a curved lower surface 1404 of the support 850. arranged opposite to the opening 832, has a second arcuate length 1402, with the second arcuate length 1402 being greater (e.g., a larger amount of length) than the first arcuate length 1400.

Figure 15:
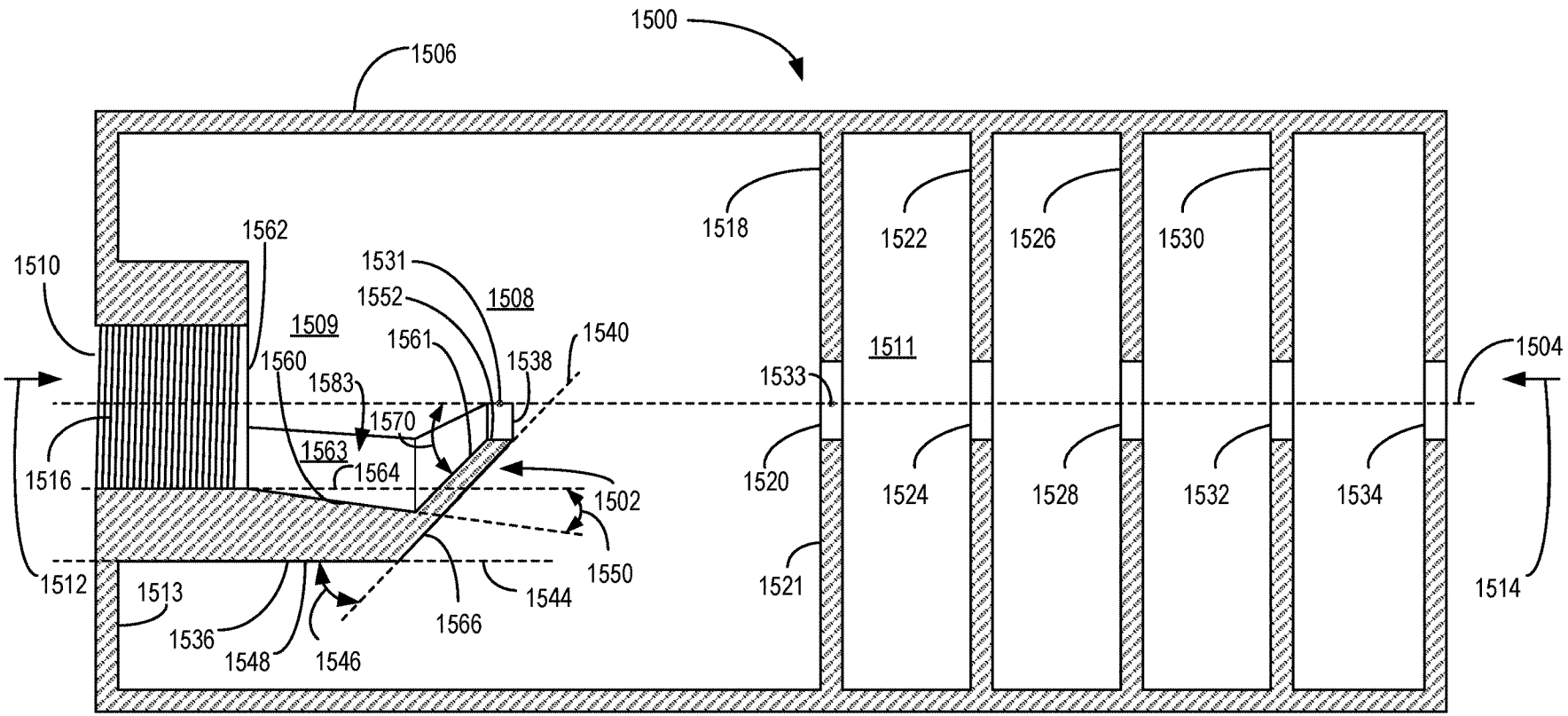
FIG. 15 shows a side sectional view of a suppressor including a gas deflector according to another embodiment of the present disclosure.

Referring to FIG. 15, a side sectional view of a suppressor 1500 including a deflector 1502 (which may be referred to herein as a gas deflector) is shown according to another embodiment of the present disclosure. The deflector 1502 has a similar shape to other deflectors described herein. For example, the deflector 1502 extends 180 degrees around the projectile entrance passage 1510. However, the interior surfaces of the deflector 1502 are oriented at angles relative to a central axis 1504 which differ from other deflectors described herein. In other examples, the deflector 1502 may extend around (e.g., arc around) the projectile entrance passage 1510 and the central axis 1504 by a different amount (e.g., 150 degrees, 120 degrees, 210 degrees, etc.).

In the example shown by FIG. 15, the suppressor 1500 includes a casing 1506 having a projectile entrance passage 1510 formed at a rearward end 1512 and a projectile exit passage 1534 formed at an opposing, forward end 1514, similar to the examples described above. The suppressor 1500 further includes a plurality of baffles disposed within an interior 1508 of the casing 1506, with each baffle extending between opposing sides of the casing 1506. In particular, the suppressor 1500 includes baffle 1518 having opening 1520, baffle 1522 having opening 1524, baffle 1526 having opening 1528, and baffle 1530 having opening 1532. Opening 1520 may be referred to herein as a baffle chamber projectile entrance, with separator wall 1521 forming both of the baffle 1518 and the opening 1520. However, in other examples, the plurality of baffles may be disposed within a central baffle tube, similar to the examples described above. The portion of the interior 1508 including the baffles may be referred to herein as a baffle chamber 1511. The suppressor 1500 may further include threads 1516 configured to engage with counterpart threads of a barrel of a firearm (e.g., a rifle) in order to couple the suppressor 1500 to the firearm. During conditions in which the suppressor 1500 is coupled to a firearm and a projectile is fired from the firearm, the projectile may travel through the suppressor 1500 along the central axis 1504 of the suppressor 1500 and through each opening of each baffle described above.

The suppressor 1500 includes deflector 1502 configured to deflect combustion gases generated by the firearm. In particular, the deflector 1502 is configured to deflect gases at the projectile entrance passage 1510 away from a path of a projectile through the suppressor 1500, similar to the examples described above.

The deflector 1502 includes a support 1536 having a curved surface 1552 curving around central axis 1504. The curved surface 1552 forms an opening 1538 of the deflector 1502, where, during conditions in which a projectile is fired by the firearm through the suppressor 1500, the projectile passes from the projectile entrance passage 1510 through the opening 1538 toward the projectile exit passage 1534. The opening 1520 may be referred to herein as a baffle chamber projectile entrance.

The deflector 1502 forms a chamber 1563 extending in an arc around the central axis 1504 (e.g., with opening 1583 of the chamber 1563 facing the central axis 1504). The portion of the interior 1508 of the suppressor 1500 at which the chamber 1563 is arranged may be referred to herein as a deflector chamber 1509, with the deflector 1502 cantilevered outward from end wall 1513 into the deflector chamber 1509. The opening 1520 connects the deflector chamber 1509 with the baffle chamber 1511. Central axis 1504 intercepts midpoint 1531 of opening 1538 and midpoint 1533 of opening 1520. The chamber 1563 is formed by a plurality of surfaces of the deflector 1502 arranged at different angles relative to each other. For example, chamber 1563 is formed in part by a first angled surface 1560 extending into the interior 1508 of the suppressor 1500 from threaded section 1562. The first angled surface 1560 is angled relative to axis 1564 by angle 1550, where the axis 1564 is arranged parallel with the central axis 1504. In some examples, the angle 1550 may be between 1-30 degrees. Some specific embodiments include angle 1550 of approximately 2, 4, 6, 8, or 10 degrees, however angle 1550 may vary from 0-45 degrees. Additionally, the deflector 1502 includes a second angled surface 1566 joining a curved lower surface 1548 to the curved surface 1552 forming the opening 1538. The second angled surface 1566 extends at an angle 1546 relative to axis 1544 and curved lower surface 1548, as indicated by the arrangement of axis 1540, parallel with second angled surface 1566, relative to axis 1544, parallel with the central axis 1504. In some examples, the angle 1546 may be 45 degrees. A third angled surface 1561 is joined to the first angled surface 1560 and is angled relative to the central axis 1504 by angle 1570. In some examples, the angle 1570 may be between 10-60 degrees. In other examples, the angle 1570 may be between 20-50 degrees. As one example, the angle 1570 may be approximately 35 degrees. In other embodiments, such as shown in FIG. 9, the angle 1570 may be orthogonal or 90 degrees.

The angled surfaces described above are exemplary and not limiting. In some embodiments, such as shown in FIG. 9, angle 1550 may be 0 degrees, and the angle 1570 may be orthogonal or 90 degrees. In some embodiments, the angles may vary as described in the paragraphs above and depicted in FIG. 15. In still further embodiments, the interior surface of the chamber 860 may be curved and form a bowl shape.

It will be understood that the figures are provided solely for illustrative purposes and the embodiments depicted are not to be viewed in a limiting sense. It is further understood that the firearm sound suppressor described and illustrated herein represents only example embodiments. It is appreciated by those skilled in the art that various changes and additions can be made to such firearm sound suppressor without departing from the spirit and scope of this disclosure. For example, the firearm sound suppressor could be constructed from lightweight and durable materials not described.

As used herein, an element or step recited in the singular and then proceeded with the word "a" or "an" should be understood as not excluding the plural of said elements or steps, unless such exclusion is explicitly stated. Furthermore, references to "one embodiment" of the present subject matter are not intended to be interpreted as excluding the existence of additional embodiments that also incorporate the recited features. Moreover, unless explicitly stated to the contrary, embodiments, "comprising," "including," or "having" an element or a plurality of elements having a particular property may include additional such elements not having that property. The terms "including" and "in which" are used as the plain-language equivalents to the respective terms "comprising" and "wherein." Moreover, the terms "first," "second," and "third," etc. are used merely as labels, and are not intended to impose numerical requirements or a particular positional order on their objects.

This written description uses examples to disclose the invention, including best mode, and also to enable a person of ordinary skill in the relevant art to practice the invention, including making and using any devices or systems and performing any incorporated methods.

Unless otherwise described, the term approximately should be construed to define a range of 5% greater and less than the stated value. For example, a range of approximately 10% would define a range between 5-15%.

It will be appreciated that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various features, functions, acts, and/or properties disclosed herein, as well as any and all equivalents thereof.

It should be appreciated that while the suppressor may be unitary in its construction, and thus in a sense virtually all of its components could be said to be in contact with one another, the terms used herein are used to refer to a more proper understanding of the term that is not so broad as to mean simply that the various parts are connected or contacting through a circuitous route because a single unitary material forms the suppressor.

The invention claimed is:

1. A suppressor, comprising:

a projectile entrance and a projectile exit;

a baffle chamber within the suppressor, the baffle chamber comprising one or more baffles;

a second chamber within the suppressor positioned between the baffle chamber and the projectile entrance;

a deflector extending from the projectile entrance outward into the second chamber, an end wall formed on an end of the deflector distal from the projectile entrance, the end wall extending towards a central axis of the suppressor, and the end wall forming an arc around the central axis, the arc extending from a first end disposed on a first side of the central axis to a second end disposed on an opposing side of the central axis.

2. The suppressor of claim 1, wherein the deflector extends along the central axis of the suppressor.

3. The suppressor of claim 1, wherein a concave cavity is formed in a side of the deflector facing the central axis of the suppressor and the concave cavity deflects gas in a radial direction of the central axis.

4. The suppressor of claim 3, wherein the end wall forms a partial circumference around the central axis.

5. The suppressor of claim 1, wherein the end wall of the deflector is positioned a distance apart from an entrance to the baffle chamber.

6. The suppressor of claim 1, wherein the suppressor is formed as a single, unitary structure.

7. The suppressor of claim 1, wherein the suppressor is manufactured using additive manufacturing or three-dimensional printing.

8. The suppressor of claim 1, wherein a concave cavity is formed in a side of the deflector facing the central axis of the suppressor and the concave cavity extends around the projectile entrance.

9. A firearms system comprising a suppressor, the suppressor comprising:

a projectile entrance and a projectile exit;

a baffle chamber within the suppressor comprising one or more baffles;

a deflector extending from the projectile entrance outward toward the baffle chamber, and the deflector having an end wall extending from a forward end of the deflector, the end wall extending in an arc around a central axis of the suppressor, and the arc extending from a first end on a first side of the central axis to a second end on a second, opposing side of the central axis.

10. The firearms system of claim 9, wherein the deflector extends in an arcuate length 210 degrees or less around one side of the central axis.

11. The firearms system of claim 9, wherein the end wall extends toward the central axis of the suppressor.

12. The firearms system of claim 11, wherein at least one further baffle tube provides a flow path separate from the baffle chamber.

13. The firearms system of claim 9, wherein the suppressor is formed as a single, monolithic structure.

14. The firearms system of claim 9, wherein a length of the deflector is between 40% and 80% of a total length from a projectile entrance side of the deflector to an opening of the baffle tube chamber.

15. A suppressor, comprising:

a projectile entrance;

a chamber within the suppressor comprising one or more baffles;

a deflector extending from the projectile entrance toward the chamber, an end wall extending from a forward end of the deflector, the end wall extending in an arc around a central axis of the suppressor from a first end of the arc on a first side of the central axis to a second end of the arc on an opposing side of the central axis.

16. The suppressor of claim 15, wherein the end wall is formed on an end of the concave cavity distal from the projectile entrance, and a first length from the projectile entrance to the end wall is greater than a second length from the end wall to the baffle chamber projectile entrance.

17. The suppressor of claim 15, wherein the suppressor is formed as a single, monolithic structure using additive manufacturing or three-dimensional printing.

18. The suppressor of claim 15, wherein the deflector extends cantilevered outward from a housing of the suppressor into the deflector chamber.

19. The suppressor of claim 18, wherein the deflector extends at a non-zero angle relative to the central axis of the deflector.

20. The suppressor of claim 15, wherein the deflector comprises a concave cavity with an opening of the concave cavity facing a central axis of the suppressor.

* * * * *